US011802434B2

(12) United States Patent
DeBoer et al.

(10) Patent No.: US 11,802,434 B2
(45) Date of Patent: Oct. 31, 2023

(54) SASH AND FRAME LATCHING ASSEMBLY

(71) Applicant: Marvin Lumber and Cedar Company, Warroad, MN (US)

(72) Inventors: Nathan H. DeBoer, Thief River Falls, MN (US); Jacob Richard Lundquist, Roseau, MN (US)

(73) Assignee: Marvin Lumber and Cedar Company, Warroad, MN (US)

( * ) Notice: Subject to any disclaimer, the term of this patent is extended or adjusted under 35 U.S.C. 154(b) by 510 days.

(21) Appl. No.: 16/213,566

(22) Filed: Dec. 7, 2018

(65) Prior Publication Data

US 2019/0178008 A1 Jun. 13, 2019

Related U.S. Application Data

(60) Provisional application No. 62/596,542, filed on Dec. 8, 2017.

(51) Int. Cl.
*E06B 3/44* (2006.01)
*E05B 65/08* (2006.01)

(52) U.S. Cl.
CPC ..... *E06B 3/4415* (2013.01); *E05B 65/0835* (2013.01); *E06B 3/4407* (2013.01)

(58) Field of Classification Search
CPC .... E05C 2003/128; E05C 3/14; E06B 3/4415; E05Y 2900/148
USPC ..... 49/449
See application file for complete search history.

(56) References Cited

U.S. PATENT DOCUMENTS 1,185,422 A * 5/1916 Mammelli ..... E05C 3/124 292/227
1,905,983 A * 4/1933 Harder ..... E05D 13/06 292/228
D126,567 S 4/1941 Borchers
2,249,132 A * 7/1941 Haslam ..... E06B 3/44 49/99
2,793,386 A 5/1957 Fritz
(Continued)

FOREIGN PATENT DOCUMENTS

DE 43 09 620 C2 * 1/1995
EM 002180497 2/2013
IN 287552-0001 10/2016

OTHER PUBLICATIONS

"Majesta Double Hung", Kolbe Windows & Doors © 2010 Kolbe & Kolbe Millwork Co., Inc., 8 pgs.
(Continued)

*Primary Examiner* — Gregory J Strimbu
(74) *Attorney, Agent, or Firm* — Schwegman Lundberg & Woessner, P.A.

(57) ABSTRACT

A latch assembly for a fenestration assembly includes a keeper ridge configured for coupling with a fenestration frame. An assembly housing is configured for coupling with a rail of a sash, including upper or lower rails opposed to a check rail of the sash. A latch mechanism is movably coupled with the assembly housing. The latch mechanism is at least partially concealed with the rail. The latch mechanism includes a handle pivotally coupled with the assembly housing and a latch arm pivotally coupled with the assembly housing and operatively coupled with the handle. The latch arm includes a locking face configured for alignment with the keeper ridge.

10 Claims, 17 Drawing Sheets

(56) References Cited

U.S. PATENT DOCUMENTS

| | | | | |
|---|---|---|---|---|
| 3,161,923 | A * | 12/1964 | Crain | E05B 65/0835 292/128 |
| D213,676 | S | 4/1969 | Biro | |
| 3,893,261 | A * | 7/1975 | Cribben | E05B 65/0835 49/449 |
| D247,844 | S | 5/1978 | Palm | |
| 4,106,239 | A * | 8/1978 | Bancroft | E05B 65/0835 160/91 |
| 4,395,847 | A * | 8/1983 | Atchison | E06B 3/42 292/DIG. 46 |
| D297,808 | S | 9/1988 | King | |
| D299,544 | S | 1/1989 | Nolan | |
| D322,385 | S | 12/1991 | Simonton et al. | |
| 5,210,976 | A | 5/1993 | Cripps | |
| D358,980 | S | 6/1995 | Mockett | |
| 5,461,837 | A | 10/1995 | Chaney et al. | |
| D365,883 | S | 1/1996 | Forbis et al. | |
| D371,500 | S | 7/1996 | Mcconnell et al. | |
| D390,086 | S | 2/1998 | Weinerman et al. | |
| D436,832 | S | 1/2001 | Matsuo et al. | |
| D442,846 | S | 5/2001 | Bastian | |
| D458,110 | S | 6/2002 | Landeros | |
| 6,547,289 | B1 * | 4/2003 | Greenheck | E05B 65/46 292/100 |
| D477,882 | S | 7/2003 | Clarkin | |
| D544,338 | S | 6/2007 | Christensen et al. | |
| D559,406 | S | 1/2008 | Boshell et al. | |
| 7,507,912 | B1 | 3/2009 | Sempliner et al. | |
| D603,056 | S | 10/2009 | Ray | |
| D618,363 | S | 6/2010 | Card | |
| RE41,863 | E | 10/2010 | Sempliner et al. | |
| 8,555,572 | B1 | 10/2013 | Bingham et al. | |
| D719,679 | S | 12/2014 | Diether | |
| D792,186 | S | 7/2017 | Key et al. | |
| D806,898 | S | 1/2018 | Zacher et al. | |
| D821,554 | S | 6/2018 | Wilson et al. | |
| D828,580 | S | 9/2018 | Often et al. | |
| D837,627 | S | 1/2019 | Poidatz et al. | |
| D859,387 | S | 9/2019 | Chung | |
| 10,557,302 | B1 | 2/2020 | Pigott, Jr. | |
| D899,919 | S | 10/2020 | DeBoer et al. | |
| D907,248 | S | 1/2021 | DeBoer et al. | |
| 11,180,942 | B1 | 11/2021 | Lawrence | |
| D938,273 | S | 12/2021 | Deboer et al. | |
| D964,599 | S | 9/2022 | Deboer et al. | |
| 2008/0129054 | A1 | 6/2008 | Tremble et al. | |
| 2009/0205257 | A1 | 8/2009 | Winner et al. | |
| 2010/0038918 | A1 | 2/2010 | Liang et al. | |
| 2010/0050483 | A1 | 3/2010 | Hsieh et al. | |
| 2011/0015789 | A1 | 1/2011 | Lajeunesse | |
| 2011/0025075 | A1 | 2/2011 | Chang et al. | |
| 2012/0192493 | A1 * | 8/2012 | Wolfe | E05B 47/0046 49/449 |
| 2013/0283694 | A1 | 10/2013 | Deboer et al. | |
| 2014/0047772 | A1 | 2/2014 | Hulst | |
| 2014/0150346 | A1 | 6/2014 | Deboer | |
| 2014/0202084 | A1 | 7/2014 | Holmes, Jr. et al. | |
| 2014/0259946 | A1 * | 9/2014 | Mansueto | E05C 7/00 49/449 |
| 2015/0042107 | A1 | 2/2015 | Glickman et al. | |
| 2017/0218667 | A1 | 8/2017 | Lane et al. | |
| 2017/0234033 | A1 | 8/2017 | Deboer et al. | |
| 2018/0202198 | A1 | 7/2018 | Hollermann et al. | |
| 2018/0245386 | A1 | 8/2018 | Binzer | |

OTHER PUBLICATIONS

"U.S. Appl. No. 29/647,405, Ex Parte Quayle Action mailed Jun. 8, 2020", 7 pgs.
"U.S. Appl. No. 29/647,405, Notice of Allowance dated Sep. 1, 2020", 5 pgs.
"U.S. Appl. No. 29/647,405, Response filed Apr. 16, 2020 to Restriction Requirement dated Oct. 16, 2019", 5 pgs.
"U.S. Appl. No. 29/647,405, Response filed Aug. 10, 2020 to Ex Parte Quayle Action mailed Jun. 8, 2020", 11 pgs.
"U.S. Appl. No. 29/647,405, Restriction Requirement dated Oct. 16, 2019", 6 pgs.
"U.S. Appl. No. 29/647,406, Notice of Allowance dated Jun. 19, 2020", 7 pgs.
"U.S. Appl. No. 29/647,406, Response filed May 26, 2020 to Restriction Requirement dated Feb. 24, 2020", 3 pgs.
"U.S. Appl. No. 29/647,406, Restriction Requirement dated Feb. 24, 2020".
"Canadian Application Serial No. 184,529, Office Action dated Aug. 18, 2020", 2 pgs.
"Canadian Application Serial No. 184,529, Office Action dated Sep. 7, 2019", 2 pgs.
"Canadian Application Serial No. 184,529, Response filed Dec. 6, 2019 to Office Action dated Sep. 7, 2019", 13 pgs.
"U.S. Appl. No. 29/751,168, Notice of Allowance dated May 7, 2021", 8 pgs.
"Single Hung Wood Windows Ultimate Single Hung G2", [Online] Retrieved from the Internet: URL: https: www.marvin.com products collections signature ultimate single-hung-g2, [Retrieved Oct. 1, 2019], (2019), 6 pgs.
"Marvin Lift Lock Hardware", Youtube, [Online] Retrieved from the Internet: URL: https: www.youtube.com.watch?v= Dr8JuCaecaU, (May 3, 2019), 1 pg.
"Residential Product Marvin Windows Introduces New Ingenious Locking Mechanism", [Online] Retrieved from the Internet: URL: https: www.residentialproductsonline.com.marvin-windows-introduces-new-ingenious-locking-mechanism, (Aug. 23, 2018), 2 pgs.
"Denvergov.org pp. 7-11_2719_W_32nd_Ave_ADU_App_08202019", [Online] Retrieved from the Internet: URL: https: www.denvergov.org content dam denvergov Portals 646 documents landmark Ipc agendas 2019 Pgs%2017-11_2719_W_32nd_Ave_ADU_App_08202019.pdf, (2019), 5 pgs.
"U.S. Appl. No. 29/751,168, Notice of Allowability dated Nov. 16, 2021", 2 pgs.
"U.S. Appl. No. 29/760,465, Restriction Requirement dated Dec. 21, 2021", 6 pgs.
"U.S. Appl. No. 29/760,465, Ex Parte Quayle Action mailed Mar. 18, 2022", 5 pages.
"U.S. Appl. No. 29/760,465, Notice of Allowance dated May 13, 2022".
"U.S. Appl. No. 29/760,465, Response filed Feb. 7, 2022 to Restriction Requirement dated Dec. 21, 2021", 19 pages.
"U.S. Appl. No. 29/760,465, Response filed Apr. 29, 2022 to Ex Parte Quayle Action mailed Mar. 18, 2022".
"Canadian Application Serial No. 3,026,762, Office Action dated Dec. 29, 2021", 5 pages.
"Canadian Application Serial No. 3,026,762, Response filed Apr. 28, 2022 to Office Action dated Dec. 29, 2021", 20 pgs.
"Canadian Application Serial No. 3,026,762, Examiner's Rule 86(2) Report dated Sep. 12, 2022", 3 pgs.
"Canadian Application Serial No. 3,026,762, Response Filed Sep. 15, 2022 to Examiner's Rule 86(2) Report dated Sep. 12, 2022", 9 pgs.
U.S. Appl. No. 29/647,405, filed May 11, 2018, Fenestration Assembly.
U.S. Appl. No. 29/647,406, filed May 11, 2018, Fenestration Latch.
U.S. Appl. No. 29/751,168, filed Sep. 18, 2020, Fenestration Latch.
U.S. Appl. No. 29/760,465, filed Dec. 1, 2020, Fenestration Assembly.

* cited by examiner

SASH AND FRAME LATCHING ASSEMBLY

CLAIM OF PRIORITY

This patent application claims the benefit of priority of Deboer et al. U.S. Provisional Patent Application Ser. No. 62/596,542, entitled "SASH AND FRAME LATCHING ASSEMBLY AND METHODS FOR SAME," filed on Dec. 8, 2017, which is hereby incorporated by reference herein in its entirety.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever. The following notice applies to the software and data as described below and in the drawings that form a part of this document: Copy right Marvin Lumber and Cedar Company, d/b/a Marvin Windows and Doors, Inc. of Warroad Minn. All Rights Reserved.

TECHNICAL FIELD

This document pertains generally, but not by way of limitation, to fenestration assemblies and latching systems for fenestration assemblies.

BACKGROUND

Fenestration latch mechanisms lock and unlock fenestration assemblies to facilitate the movement of panels, such as sashes, doors or the like. Hung windows, such as double hung windows, are one example of a fenestration assembly. Hung windows include a fenestration frame and at least one sash slidable within the frame. In some examples, the latch assembly includes hardware installed on the check rails, for instance the check rails of each of first and second sashes. The hardware includes a latch coupled with the check rail of the first sash and a keeper coupled with the check rail of the second sash. With the first and second sashes in the closed position the latch is rotated into engagement with the keeper. The engagement of the latch and the keeper prevents movement of the sashes from the closed position.

In other examples, hung windows include latch mechanisms mounted on the check rail, and the hardware remotely operates one or more latch bolts movably coupled with the sash proximate the check rail. For instance a cord is coupled between the latch bolts and the hardware. Operation of the hardware moves the latch bolts into the sash (e.g., withdraws the latch bolts into the check rail) and permits movement of the sash.

SUMMARY

The present inventors have recognized, among other things, that a problem to be solved can include providing access to latch mechanisms at locations remote from sash check rails. In at least some examples fenestration assemblies are especially large (e.g., having heights of five feet, six feet or more) or are installed with the check rail latch mechanisms at elevated or difficult to reach locations (remote locations), such as great rooms, large living rooms, foyers, behind counters and sinks or the like. It is difficult for some users to reach and operate latch mechanisms in large fenestration assemblies or with fenestration assemblies having the latch mechanism at remote locations. This is especially frustrating for elderly and handicapped users. In other examples, tools are needed to reach and operate remote latch mechanisms including, but not limited to, extension poles, manipulators or the like.

Further, in some examples building codes mandate that latch mechanisms are installed at easy to reach locations (i.e., near the floor of a room) that frustrate the traditional installation of a fenestration assembly. The check rail latch mechanism is installed relatively near to the floor (in an example, within 48 inches) to comply with building codes, and the sill of the fenestration assembly is accordingly installed at an even lower elevation proximate to the floor in a non-traditional manner. Schools are one example of buildings that may require latch mechanisms near the floor to facilitate egress by children.

The present subject matter helps provide a solution to this problem with one or more latch assemblies configured for coupling between sashes and frames. One example of a latch assembly includes a keeper ridge coupled with a fenestration frame, for instance, near a sill or header of the frame in contrast to the check rails of the sashes. The latch assembly further includes a latch mechanism coupled with a rail of a sash opposed to the check rail (e.g., a rail proximate the respective sill or header and remote from the check rail). The latch mechanism is partially concealed within the rail and includes a handle. Operation of the handle moves a latch arm having a locking face. In a locked configuration the locking face is aligned with the keeper ridge and holds the sash static within the frame. In an unlocked configuration the handle is moved and the latch accordingly misaligns the locking face with the keeper ridge. The sash is thereby released for movement within the frame. The latch assembly is positioned remote relative to the check rails, and in at least one example is provided at an easy to reach and operate location, proximate the sill of the fenestration frame and a lower rail of the sash opposed to the check rail. Accordingly, the latch assembly is accessible and readily operated (and the window opened and closed) by the elderly, handicapped, children or the like. Further, a fenestration assembly in a remote location (elevated or a difficult to reach location) including the latch assembly is readily locked and unlocked (and opened and closed) because the latch assembly is readily accessible compared to check rail mounted latch assemblies.

The present inventors have further recognized, among other things, that another problem to be solved can include concealing latch assemblies and correspondingly enhancing the aesthetic appeal of fenestration assemblies. In some examples, fenestration assemblies include latch assemblies installed on a rail (e.g., externally or with significant portions of the assembly externally visible). For instance, hardware including a latch is coupled over a rail and is interfit between the rail and the frame to interact with a feature of the frame. External mounted hardware decreases the aesthetic appeal of the fenestration assembly by covering or obscuring woodwork, decorative trim or the like.

The present subject matter helps provide a solution to this problem with one or more latch assemblies concealed within rails of the fenestration assembly. In one example a keeper ridge of the latch assembly is provided in the fenestration frame. For instance, the keeper ridge is within the fenestration frame, concealed within a channel of the frame or concealed by a trim piece of the frame. The latch mechanism is housed within the rail, and a latch arm including a locking face is concealed by one or more of the rail or the frame (while the sash is closed). Further, the locking face aligns with the keeper ridge in a locked and closed configuration to hold the sash static. The aligned locking face and keeper ridge are concealed by the fenestration assembly (e.g., the rail and optionally the frame). Further still, with the sash open the latch mechanism is concealed within the rail while an operator, such as a handle, projects from the rail in a manner similar to a finger pull. Optionally, only a portion of the latch arm including the locking face projects from the rail while the remainder of the latch mechanism (e.g., the remainder of the latch arm, an operator arm or the like) is concealed by the rail.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
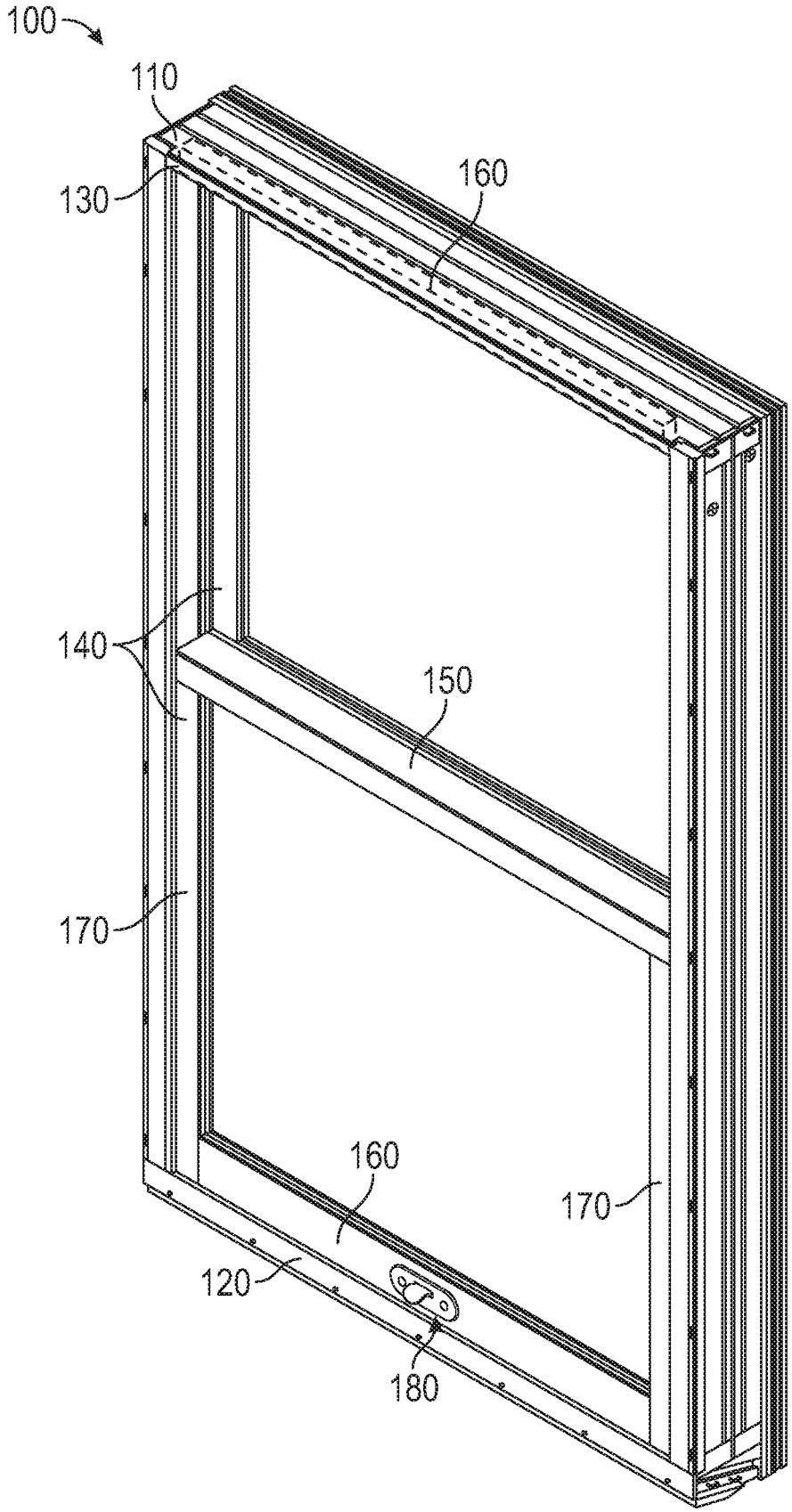
FIG. 1 is a perspective view of a fenestration assembly including a latch assembly coupled between a sash and a fenestration frame.

FIG. 1 is a perspective view of a fenestration assembly 100 including a latch assembly 180 coupled between a sash 140 and a fenestration frame 110. The fenestration frame 110 is configured for installation within structures, including (but not limited to) a single-family residence, multi-family residence, municipal building office building, warehouse or the like. In an example, the fenestration assembly 100 includes at least one of a casement window, single hung window, double hung window, awning window, sliding window or the like coupled with a wall of a structure. As shown, the fenestration frame 110 includes a sill 120 and a header 130.

One or more sashes 140, for instance a first sash 140A and a second sash 140B, are coupled to the fenestration frame 110, and the one or more sashes are moveable relative to the fenestration frame 110 between an open position and a closed position. In one example, the sashes 140 are configured to slide relative to the fenestration frame 110. In another example, the sashes 140 are rotatable relative to the fenestration frame 110 (e.g., the sash 140A may rotate between an open position and a closed position, for instance as a casement window, awning window or the like).

In the example shown in FIG. 1, the sashes 140 include a check rail 150 and an opposed rail 160 (shown in solid and dashed lines) spaced from the check rail 150 by one or more stiles 170. The opposed rail 160 is opposed to (e.g., spaced from) the check rail 150. The one or more sashes 140 optionally include a pane of glass. In an example, the pane of glass is located between (and supported by) the check rail 150, the opposed rail 160, and the stiles 170.

As described in greater detail herein, the latch assembly 180 is coupled between the sashes 140 (e.g., the second sash 140B) and the frame 110. The latch assembly 180 includes a locked and an unlocked configuration. In the locked configuration, the sashes 140 (e.g., the first sash 140A) are held static relative to the frame 120 (e.g., the sash 140A is locked in the closed position).

Figure 2A:
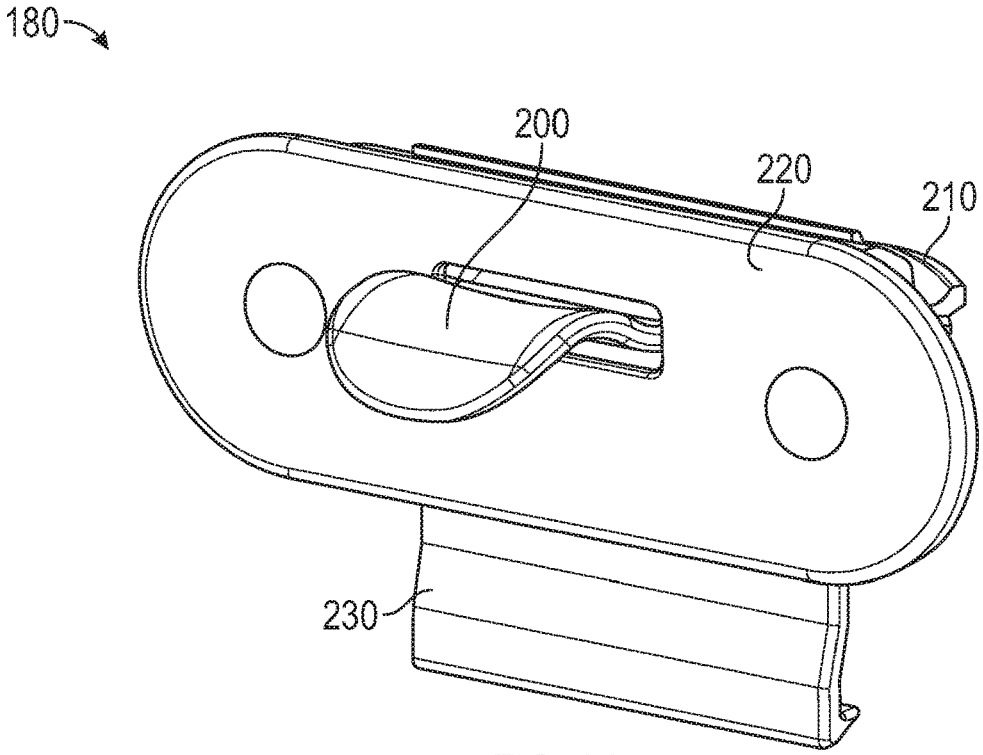
FIG. 2A is a first perspective view of the latch assembly of FIG. 1.

FIG. 2A is a first perspective view of the latch assembly 180 of FIG. 1. The latch assembly 180 includes a handle 200 to change the configuration of the latch assembly 180 between the locked and unlocked configurations. For instance, the handle 200 is operated (e.g., by a user, an actuator, or the like) and moved to reposition the handle 200 within the latch assembly 180 and accordingly change the configuration of the latch assembly 180. In another example, the handle 200 is moved in a parallel direction to movement of the sash 140A. Accordingly movement of the handle 200 correspondingly unlocks and moves the sash 140A with a single motion. For instance, the handle 200 is used as a finger pull to unlock the latch assembly 180 and to move the sash 200 relative to the frame 110.

In one example, the latch assembly 180 includes an assembly housing 210 that encloses one or more components of the latch assembly 180. For instance, the components of the latch assembly 180 enclosed by the assembly housing 210 are collectively referred to as a latch mechanism 250, and the latch mechanism is included in the sash 140. In some examples, the assembly housing 210 facilitates installation of the latch assembly 180 into a corresponding recess within the fenestration assembly (e.g., a recess within the rail 160 shown in FIG. 1). The latch assembly 180, for instance the latch mechanism 250, is readily concealed within the rail to minimize interruption of the aesthetic appearance of the window. An escutcheon 220 is optionally included with the latch assembly 180 to provide an aesthetic cover to the latch assembly 180 (e.g., to cover the recess within the rail 160). In still other examples, an enclosure such as the assembly housing 210 is provided integrally by the sash 140. For instance, the sash 140 includes a routed recess, molded recess or the like configured to enclose (and conceal) components of the latch assembly 180.

As described in greater detail herein, the latch assembly 180 includes a latch arm 230 that cooperates with other components of the latch assembly 180 (e.g., the keeper 400 shown in FIG. 4) to selectively lock, unlock, and automatically lock (e.g., autolock) the sashes 140. The latch arm 230 is selectively aligned with the opposed feature of the fenestration frame 110 such as a keeper, keeper ridge or the like to hold the sashes 140 static relative to the frame 110. For instance, the latch arm 230 optionally includes a locking face 231 that is aligned with the frame 110 to hold the sashes 140 static (e.g., inhibit movement, such as sliding rotation, tilting or the like) relative to the frame 110.

Figure 2B:
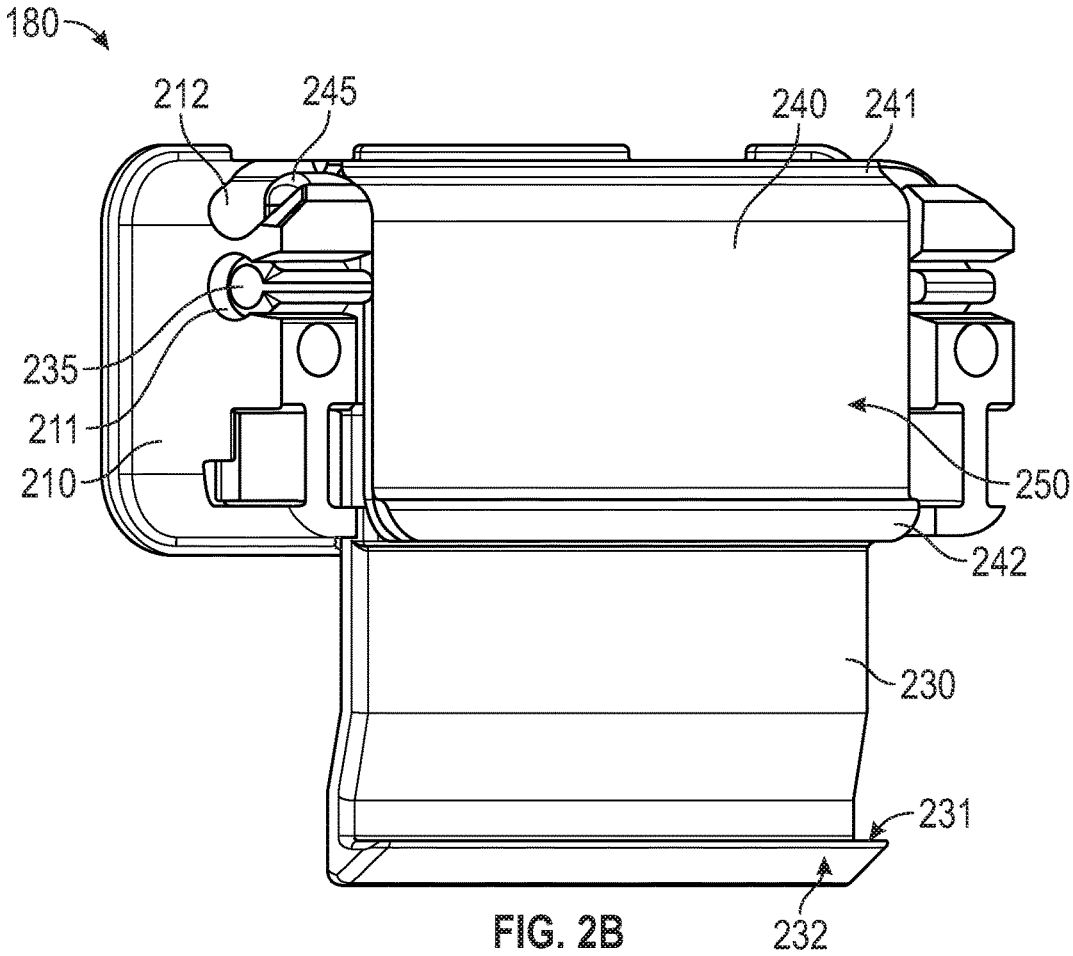
FIG. 2B is a second perspective view of the latch assembly of FIG. 1.

FIG. 2B is a second perspective view of the latch assembly 180 of FIG. 1 showing another side of the assembly 180 relative to FIG. 2A. As shown in FIG. 2B, the latch assembly 180 optionally includes an operator 240 as a component of the latch mechanism 250. In some examples, the handle 200 is coupled with the operator 240, and the operator 240 is interposed between the handle 200 and the latch arm 230 to couple (e.g., interlink) the handle 200 with the latch arm 230. In one example, the operator 240 is a protrusion (e.g., arm, lever, paddle, member, or the like) extending from the handle 200, and the operator 240 is configured to engage with, and disengage from, the latch arm 230 to change the configuration of the locking assembly 230 between locked and unlocked configurations, as discussed herein.

Referring again to FIG. 2B, the assembly housing 210 optionally encloses one or more components of the latch assembly 180. In one example, the assembly housing 210 defines a first pivot recess 211 with an arm pivot 235 of the latch arm 230 received therein. As shown, the shape of the pivot recess 211 corresponds to the shape of the arm pivot 235 to facilitate rotation of the latch arm 230 relative to the assembly housing 210. In another example, the assembly housing 210 defines a second pivot recess 212 that receives an operator pivot 245 of the operator 240. The pivot recess 212 optionally has a corresponding shape to the shape of the operator pivot 245 to facilitate rotation of the operator 240 relative to the assembly housing 210.

In an example, the operator 240 is selectively engaged and disengaged with the latch arm 230. Operation of the handle 200 (e.g., manipulation by a user) causes rotation of the arm pivot 235 at the pivot recess 211 and causes movement of the latch arm 230. For instance, the operator pivot 245 is located at a first end 241 of the operator 240 and is within the second pivot recess 212. The operator pivot 245 is optionally located on a first side of (e.g., above) the latch pivot 235. The handle 200 is selectively moved (e.g., in a direction parallel to movement of the sashes 140), and the operator pivot 245 rotates within the pivot recess 212. Accordingly, movement of the handle 200 rotates the operator 240 as the operator pivot 245 rotates within the pivot recess 212. In this example, a second end 242 of the operator 240 is coupled with the latch arm 230, and movement of the operator 240 causes a corresponding movement (e.g., rotation, deflection, articulation, or the like) of the latch arm 230 through this coupling. As a result, movement of the handle 200 causes the latch arm 230 to move relative to the latch assembly 180. As described herein the coupling of the operator 240 with the latch arm 230 includes a selective engagement and disengagement therebetween. In an example, the second end 242 of the operator 240 is located between the latch pivot 235 and the locking face 231, for instance on a second side of (e.g., below) the latch pivot 235. The second end of the operator 240 selectively engages with, or disengages from, the latch arm 230 between the latch pivot 235 and the locking face 231.

As further described herein, the latch assembly 180 optionally autolocks one or more of the sashes 140 (e.g., one or more of the first or second sashes 140A, 140B) to hold one or more of the sashes 140 static relative to the fenestration frame 110. Referring again to FIG. 2B, the latch arm 230 optionally includes a resetting face 232 (e.g., a tapered surface, inclined surface, or the like). The resetting face 232 is configured for engagement with a frame feature (e.g., one or more of the fenestration frame 110, the keeper 400 shown in FIG. 4 or the like) to slide over the frame feature, for instance during closing of the sash 140. The engagement of the resetting face 232 with the frame feature biases the locking face 231 of the locking arm 230 toward misalignment with the frame feature through rotation of the latch arm 230 and accordingly the locking face 231 travels past the frame feature. In this example, after the resetting face 232 moves beyond the frame feature (e.g., with closing of the sash 140), the latch arm 230 moves the locking face 231 into alignment with the frame feature to automatically lock the sash 140 and hold the sash 140 static relative to the frame 110. As described herein, the latch arm 230 is biased with a biasing element, such as a leaf spring coil spring torsion spring elastomer or the like to bias the locking face 231 toward alignment with the frame feature.

Figure 3:
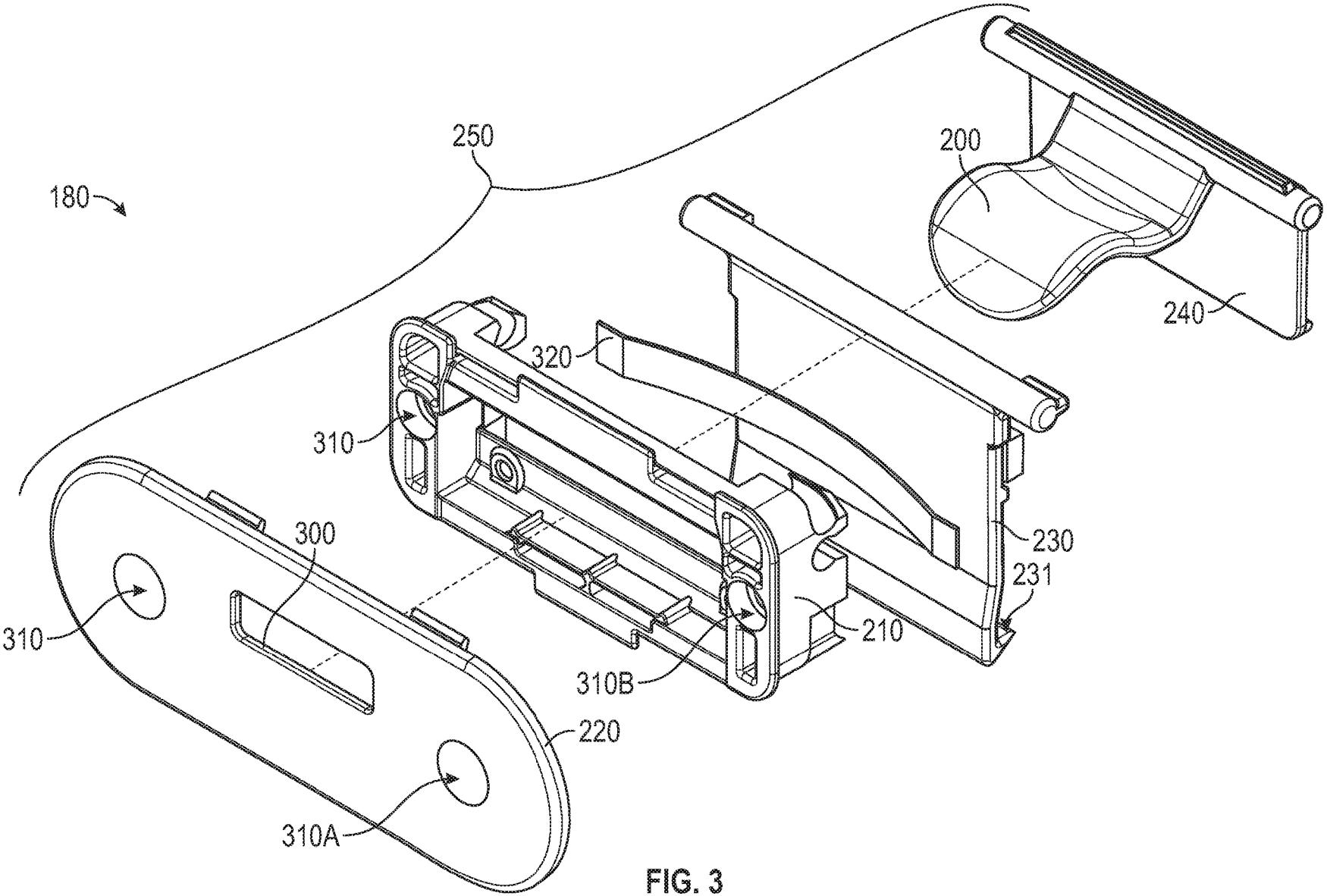
FIG. 3 is an exploded view of the latch assembly of FIG. 1.

FIG. 3 is an exploded view of the latch assembly 180 of FIG. 1. As previously described, the latch assembly 180 includes the latch mechanism 250. As described herein, the escutcheon 220 is optionally included in the latch assembly 180 to provide an aesthetic cover to the latch assembly 180. For instance, the escutcheon 220 covers a recess within the rail 160 (shown in FIG. 1) for the latch assembly 180 and optionally one or more components of the latch mechanism 250. Optionally, the escutcheon 220 includes one or surface features to enhance the aesthetic appeal of the assembly 180 and the fenestration assembly 100. For instance, the escutcheon 220 includes surface features, such as embossed features (e.g., decorative engravings or the like) or decorative domes (e.g., protrusions from a surface of escutcheon 220). In another example, the escutcheon 220 includes one or more materials that correspond with other features of the fenestration assembly 100 or room including the assembly. In an example, the fenestration assembly 100 is included in a bathroom, and the escutcheon 220 includes a bronze material that corresponds with the bronze material of plumbing fixtures within the bathroom.

In the example shown in FIG. 3 the escutcheon 220 includes a handle orifice 300 that receives the handle 200. Additionally, the locking mechanism 250 includes one or more through holes 310. For instance, the escutcheon 220 optionally includes a first through hole 310A, and the assembly housing 210 includes a second through hole 310B. The through holes 310A, 310B are aligned and facilitate coupling the latch mechanism 250 with the fenestration assembly (e.g., the rail 160). The through holes 310 are configured to receive a fastener, and the fastener engages with the fenestration assembly 100 to couple the locking mechanism 250 with the fenestration assembly 100.

Figure 4:
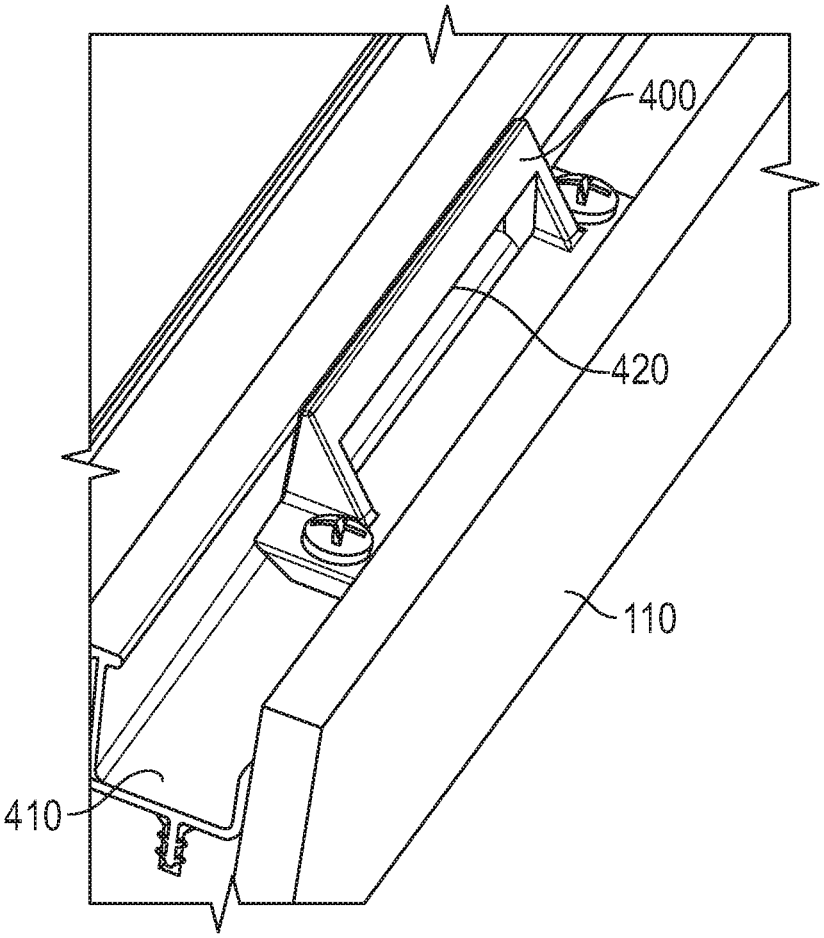
FIG. 4 is a perspective view of a keeper coupled with the fenestration frame.

In some examples, and as described in greater detail herein, the latch mechanism 250 includes a biasing element 320 (e.g., a leaf spring compression spring torsion spring elastomer or the like) that biases a component of the mechanism 250, such as the latching arm 230, toward an aligned position with the fenestration frame 100 (e.g., the keeper 400 or keeper ridge 420 shown in FIG. 4). As shown in FIG. 3, the biasing element 320 is interposed between the assembly housing 210 and the latch arm 230. The biasing element 320 biases (e.g., pushes, pulls, or the like) the latch arm 230 with respect to the assembly housing 210. In the example shown in FIG. 4, the biasing element 320 biases the latch arm away from the housing 210 and toward a feature of the fenestration assembly 100, such as the keeper 400. As further shown in FIG. 4, and shown in assembled views herein, the biasing element 320 indirectly biases the operator 240 engaged along a portion of the latch arm 230, and correspondingly biases the handle 200. Operation of the handle 200 to unlock the sash 140 overcomes the bias from the biasing element 320 and moves the latch arm 230 to move the locking face 231 from the fenestration frame 110 (e.g., out of alignment with the keeper 400).

FIG. 4 is a perspective view of a keeper 400 coupled with the fenestration frame 110, for instance along one or more of the sill 120 or header 130. The keeper 400 is optionally positioned within a frame channel 410 of the fenestration frame 110 (e.g., proximate the sill 120 shown in FIG. 1). With the keeper 400 coupled to the frame 110 and within the frame channel 410 the keeper 400 is at least partially concealed (e.g., obscured) by the frame 110. In this example, with the sash 140 (FIG. 1) in the closed position, the keeper 400 is concealed from view, for instance by the rail 160.

As further shown in FIG. 4, the keeper 400 optionally projects from the frame 110 and provides a feature, such as a keeper ridge 420, that couples with the latch arm 230 (shown in FIGS. 2A, 2B) to hold the sash 140 static relative to the frame 110. In another example, the fenestration frame 110 provides the keeper 400 including a keeper ridge 420 or other feature formed directly in the frame 110 (e.g., through molding routing or the like). For example, a slot, recess or the like is provided in the frame 110 and the keeper ridge 420 corresponds to an edge of the frame 110 within the slot or recess.

Figure 5B:
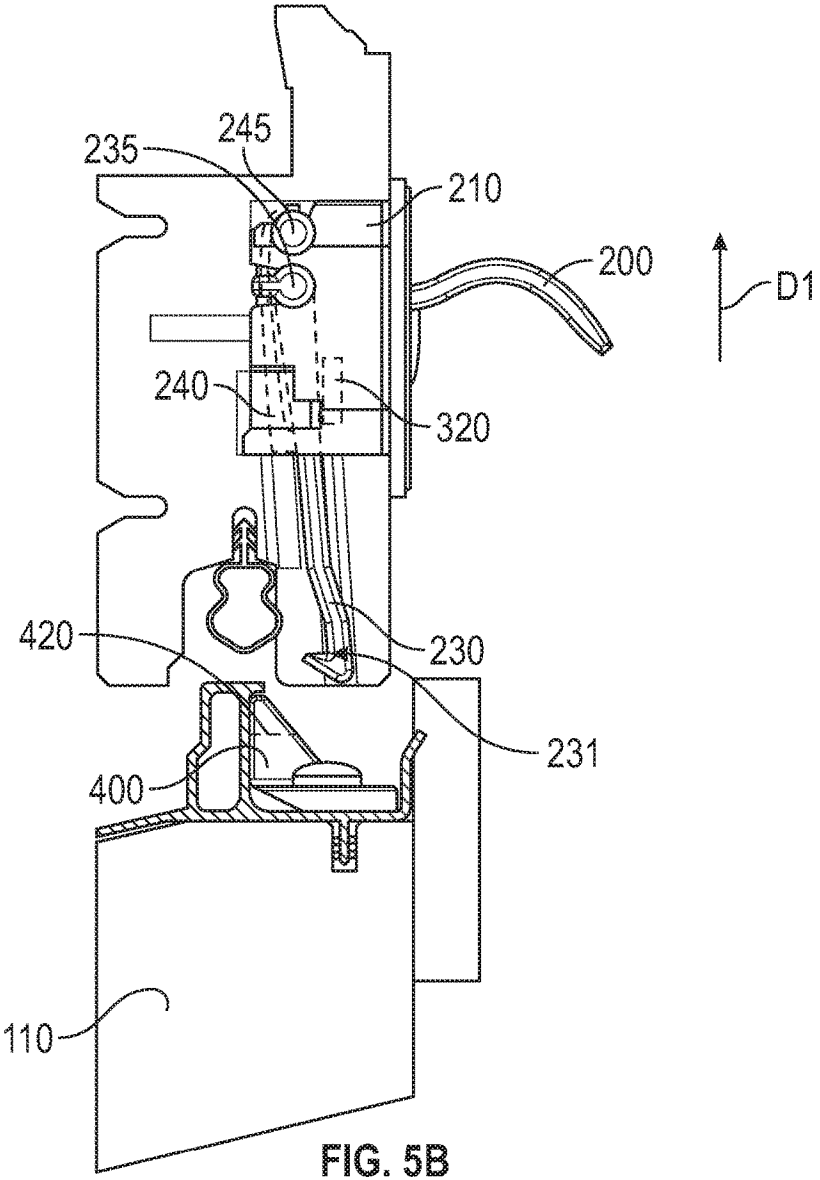
FIGS. 5A-5C are cross sectional views of the latch assembly of FIG. 1 in locked, unlocked, and resetting configurations.
Figure 5A:
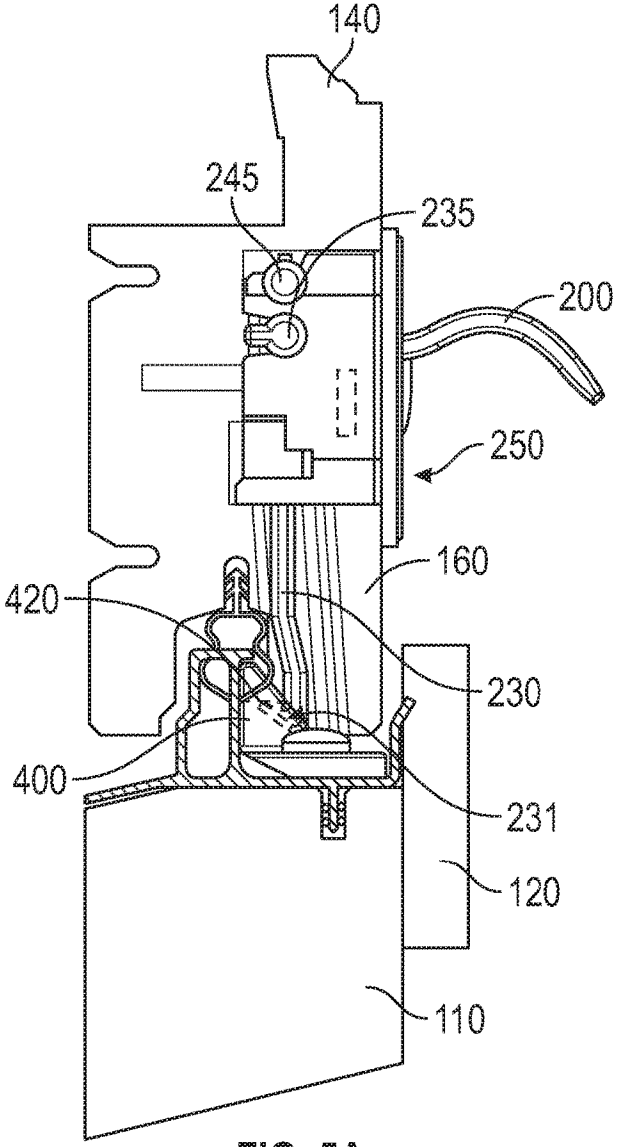

FIG. 5A is a cross sectional view of the latch assembly 180 of FIG. 1 in a locked configuration. In the locked configuration, the latch arm 230 of the latch mechanism 250 is engaged with the keeper 400 to hold the sash 140 static relative to the fenestration frame 110. The locking face 231 (shown in FIG. 2B) of the latch arm 230 is aligned with the keeper ridge 420 (shown in FIG. 4) and positioned thereunder. Optionally, while aligned the latch arm 230 is engaged against the ridge 420, the locking face 231 is seated under the ridge 420 or spaced therefrom through tolerance or design. With this arrangement of the locking face 231 aligned to the keeper 400 the sash 140 is locked in the fenestration frame 110 in the closed position. In this example, if a user attempts to move the sash 140 relative to the frame 110, the engagement of the locking face 231 with the keeper ridge 420 prevents movement of the sash 140 relative to the frame 110.

FIG. 5B is a cross sectional view of the latch assembly 180 of FIG. 5A in an unlocked configuration. In the unlocked configuration, the latch arm 230 of the latch mechanism 250 is misaligned relative to the keeper 400. Accordingly, the sash 140 is freed and movable relative to the frame 110 toward the open position. In this example, the handle 200 initiates the change in configuration. For instance, the handle 200 is moved in the direction of arrow D1. Movement of the handle 200 operates the latch mechanism 250 to move the latch arm 230 and misalign the locking face 231 with the keeper ridge 420 (shown in FIG. 4) to unlock the latching assembly 180. In some examples, movement of the handle 200 overcomes the bias of the biasing element 320 and, for instance, compresses the biasing element 320 while moving the latch arm 230. Accordingly, the latch arm 230 is biased toward the assembly housing 210. Optionally, continued movement of the handle 200 in the direction of arrow D1 is transmitted to the sash 140 to open the sash. Accordingly, the sash 140 is unlocked and opened in a single movement by the user instead of requiring multiple operations to unlock the sash 140 and move the sash toward the open position through pulling on a finger pull lifting at the checkrail or the like.

Figure 5C:
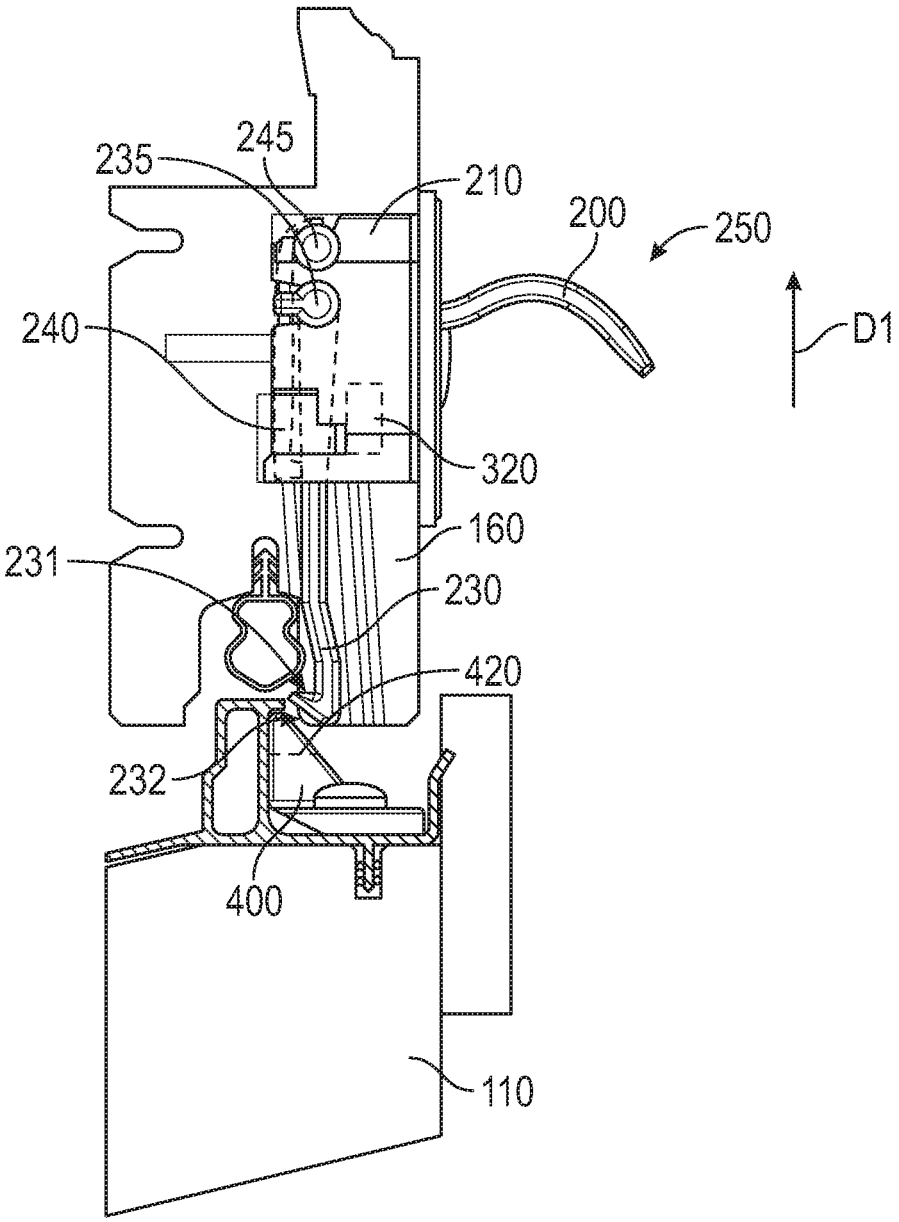

FIG. 5C is a cross sectional view of the latch assembly 180 of FIG. 1 in a resetting configuration, a configuration that readies the fenestration assembly 100 to automatically lock with closing of the sash 140. In an example, the handle 200 is released, and the biasing element 320 biases the latch arm 230 into the locked configuration. Because the handle 200 is released, the biasing element is decompressed and biases the latch arm 230 away from the assembly housing 210 (toward the left side of the page) and the latch arm 230 is again aligned with the keeper 400. As the sash 140 is moved toward the closed position, the resetting face 232 slides over the keeper ridge 420 and biases the locking face 231 around the keeper ridge 420. With continued closing movement the resetting face 232 disengages with the keeper 400, such as the keeper ridge 420, and the locking face 231 returns to the aligned position with the keeper (including the ridge 420) and is seated beneath the keeper ridge 420 (see FIG. 5A).

In another example, the latch mechanism 250 of the latch assembly 180 includes the operator 240 coupled with the handle 200. As previously described the operator 240 provides an intermediate component that couples the latch arm 230 with the handle 200. Referring again to FIG. 3, as shown in that example the operator 240 is selectively engageable with the latch arm 230 based on rotation of the handle 200 and the latch arm 230 (e.g., as the latch arm 230 is rotated by the biasing element 320). In one example, the operator 240 ensures the locking face 231 of the latching arm 230 is not forced into an aligned position with the keeper ridge 420, and the operator 240 thereby prevents crashing of the latch arm 230 with the keeper 400 or the fenestration frame 110.

Referring to FIG. 5B movement of the handle 200 in a direction opposed to D1 in the Figure decouples the operator 240 from the latching arm 230 (e.g., the operator 240 is selectively disengaged from the latching arm 230). Accordingly, the opposed movement does not drive and hold the latching arm 230 in the configuration shown in FIG. 5C. Instead, the latching arm 230 is biased toward the configuration shown in FIG. 5C by the biasing element 320. Accordingly, as the sash 140 is closed the latching arm 230 naturally deflects according to sliding engagement between the resetting face 232 and the keeper ridge 420.

In one example, with the operator 240 coupled to the latching arm 230 when the handle is moved in the direction opposite D1, the opposed motion app lied to the handle 200 to close the sash 140 may drive and hold the latch arm 230 in the configuration shown in FIG. 5C (e.g., the latch arm 230 is driven away from the assembly housing 130, or toward the left of the page). In an example, upon closing the sash 140, if the latch arm 230 is forcefully held in place the components of the latch assembly 180 crash together causing wear, damage or the like because the latch arm 230 is driven into alignment with the keeper 400 (e.g., away from the assembly housing 130), instead of the latch arm 230 naturally moving toward misalignment with the keeper 400 (e.g., toward the assembly housing 130) through engagement between the resetting face 232 and the keeper ridge 420.

In contrast, the decoupling of the operator 240 from the latch arm 230 when the handle 200 is moved in the direction opposed to D1 facilitates the resetting face 23 and the locking face 231 travelling past the keeper ridge 420 and accordingly prevents crashing of the components of the latch assembly 180.

Figure 15A:
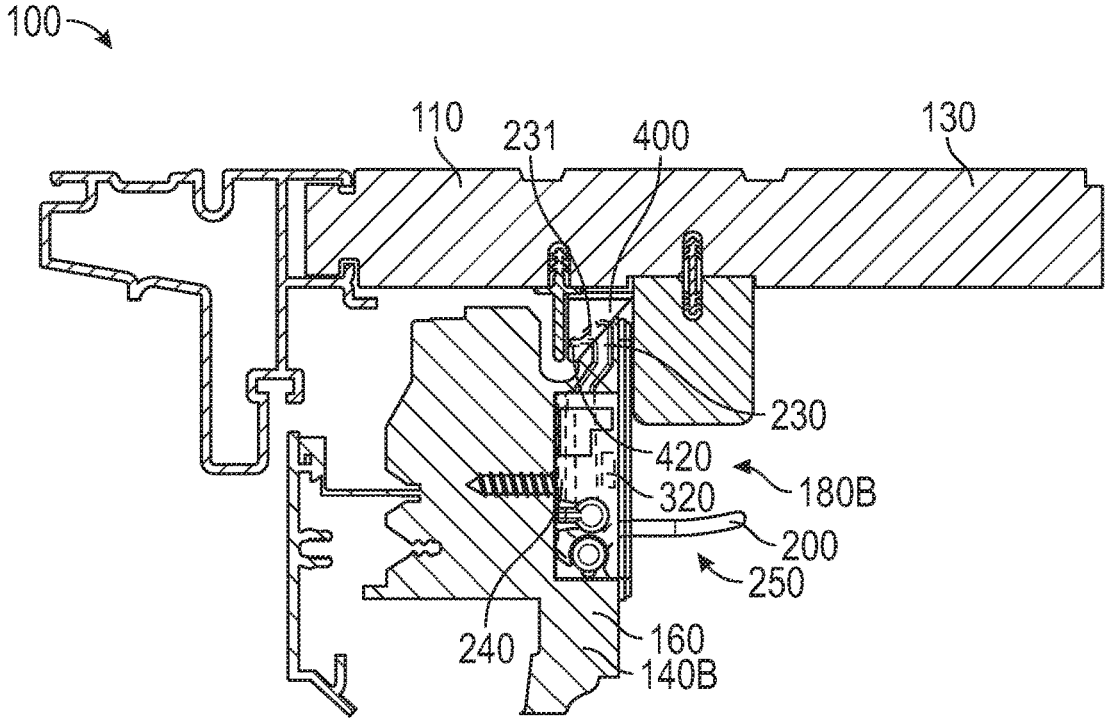
FIG. 15A is a cross sectional view of the latch assembly of FIG. 13 in a locked configuration.

Referring again to FIG. 5C, the latch mechanism 250 is concealed by one or more of the sash 140, the rail 160 (shown in FIG. 1), or the frame 110. As shown in FIG. 5C, the assembly housing 210 is concealed within the rail 160. Additionally, the latch arm 230 is concealed by the rail 160. In an example, the latch arm 230 does not extend beyond an edge of the opposed rail 160. In another example, the latch arm 230 is not visible when the sash 140 is in the open position or the closed position. In yet another example, the locking face 231 projects from the rail 160 while the remainder of the latch mechanism 250 (e.g., the remainder of the latch arm 230, the operator 240, or the like) is concealed by the rail 160. As shown in FIG. 5A, when the sash 140 is in the closed position, the handle 200 and the latch arm 230 are proximate (e.g., close to, adjacent, near, or the like) the sill 120 of the fenestration frame 110. Accordingly, when closed the latch mechanism 250 is concealed by the rail 160 and the fenestration frame 110. In another example, and as shown in FIG. 15A, the handle 200 and the latch arm 230 are proximate the header 130 when the sash 140 is in the closed position.

With the latch assembly 180 proximate either (or both with dual assemblies) of the rails 160, such as the sill 120 or header 130, the latch assembly 180 is readily accessed and operated from a convenient location. For instance, with the latch assembly 180 proximate the sill the assembly including the handle 200 and the latch mechanism 250 are operated near to the floor of a room (e.g., by children in a school, disabled users, elderly or the like) to unlock and open the fenestration assembly 100 with a single operation, for instance in direction D1 shown in FIG. 5B. Additionally, the lower access provided with the latch assembly 180 facilitates both locking and unlocking and opening and closing of the fenestration assembly from a lower position. Accordingly, large fenestration assemblies otherwise including locking hardware proximate check rails are minimized in favor of the more easily accessible latch assembly 180.

Figure 6:
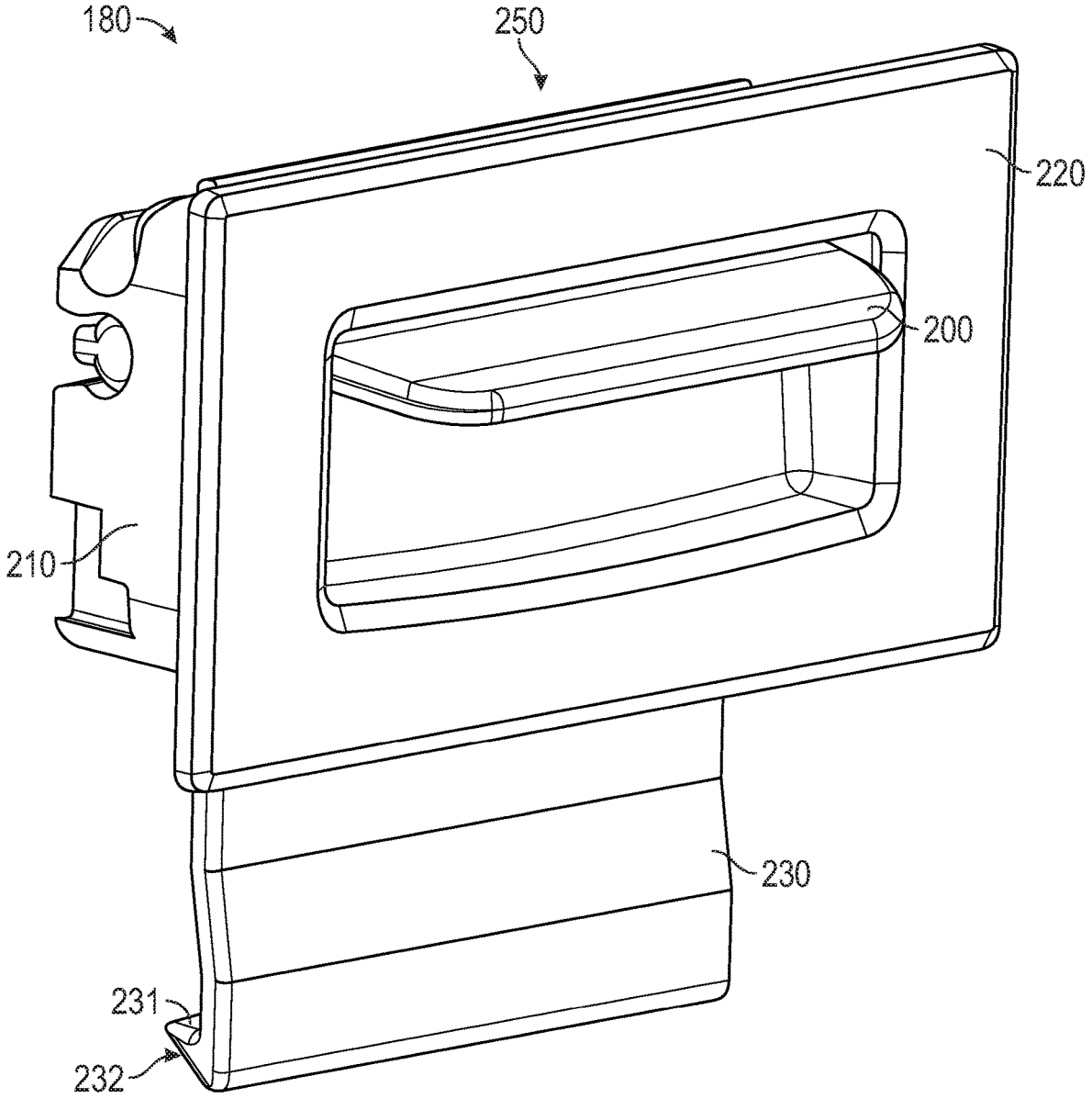
FIG. 6 is a perspective view of another example of a latch assembly.

FIG. 6 is a perspective view of another example of the latch assembly 180. The latch assembly 180 includes the handle 200, the assembly housing 210, the escutcheon 220, the latch arm 230, the lock face 231, and the resetting face 232. The latch assembly 180 is configured for concealment within the fenestration assembly 100 (e.g., the sash 140). In the example shown in FIG. 6, the escutcheon 220 has a different profile from the escutcheon 220 previously shown in FIG. 3. For instance, and as shown in FIG. 3, the escutcheon 220 includes an oval profile. In another example, and as shown in FIG. 6, the escutcheon 220 includes a rectangular profile. In yet another example, the escutcheon 220 includes a geometric (e.g., triangular, or other polygon) profile or the like. Additionally, the escutcheon 220 in FIG. 6 does not include the one or more through holes 310 (see FIG. 3).

Figure 7:
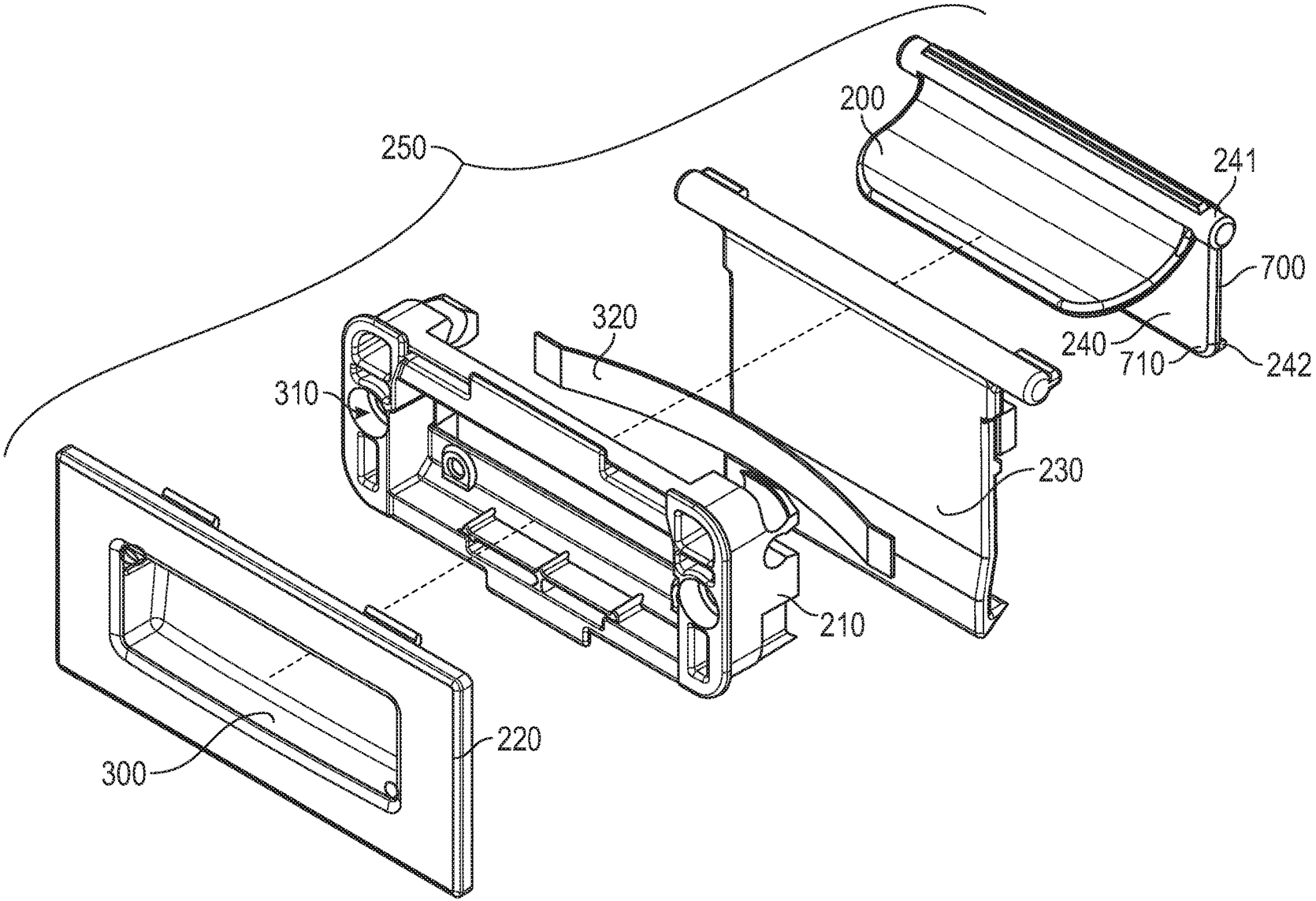
FIG. 7 is an exploded view of the latch assembly of FIG. 6.

FIG. 7 is an exploded view of the latch assembly 180 of FIG. 6. As described herein, the assembly housing 210 optionally includes the one or more through holes 310 to facilitate coupling the latch mechanism 250 with the fenestration assembly 100 (e.g., with one or more fasteners). In this example, the escutcheon 200 conceals components of the latch assembly 180. For instance, the escutcheon 220 is configured to cover the through holes 310 in the assembly housing 210 and thereby increase the aesthetic appeal of the latch assembly 180 (and the fenestration assembly 100).

In other examples, the handle 200 includes one or more handle profiles. As shown in FIG. 3, in one example the handle 200 includes an undulating (e.g., curved, S-shaped, sinusoidal, or the like) profile. In the example shown in FIG. 7, the handle 200 includes a semicircular profile. The handle orifice 300 includes an orifice profile that corresponds with the one or more handle profiles to facilitate the reception of the handle by the escutcheon 220.

Referring again to FIG. 7, in an example, the operator 240 includes an operator arm 700 extending between the first end 241 and the second end 242 of the operator 240. The second end 242 of the operator 240 optionally includes a boss feature 710, such as a projection, ridge or the like that engages with the latch arm 230 to facilitate movement of the latch arm 230. Additionally, and in the example shown in FIG. 7, the latch assembly 180 includes the biasing element 320 that engages with the locking arm 230 and biases the locking arm 230 with respect to the assembly housing 210.

Figure 8:
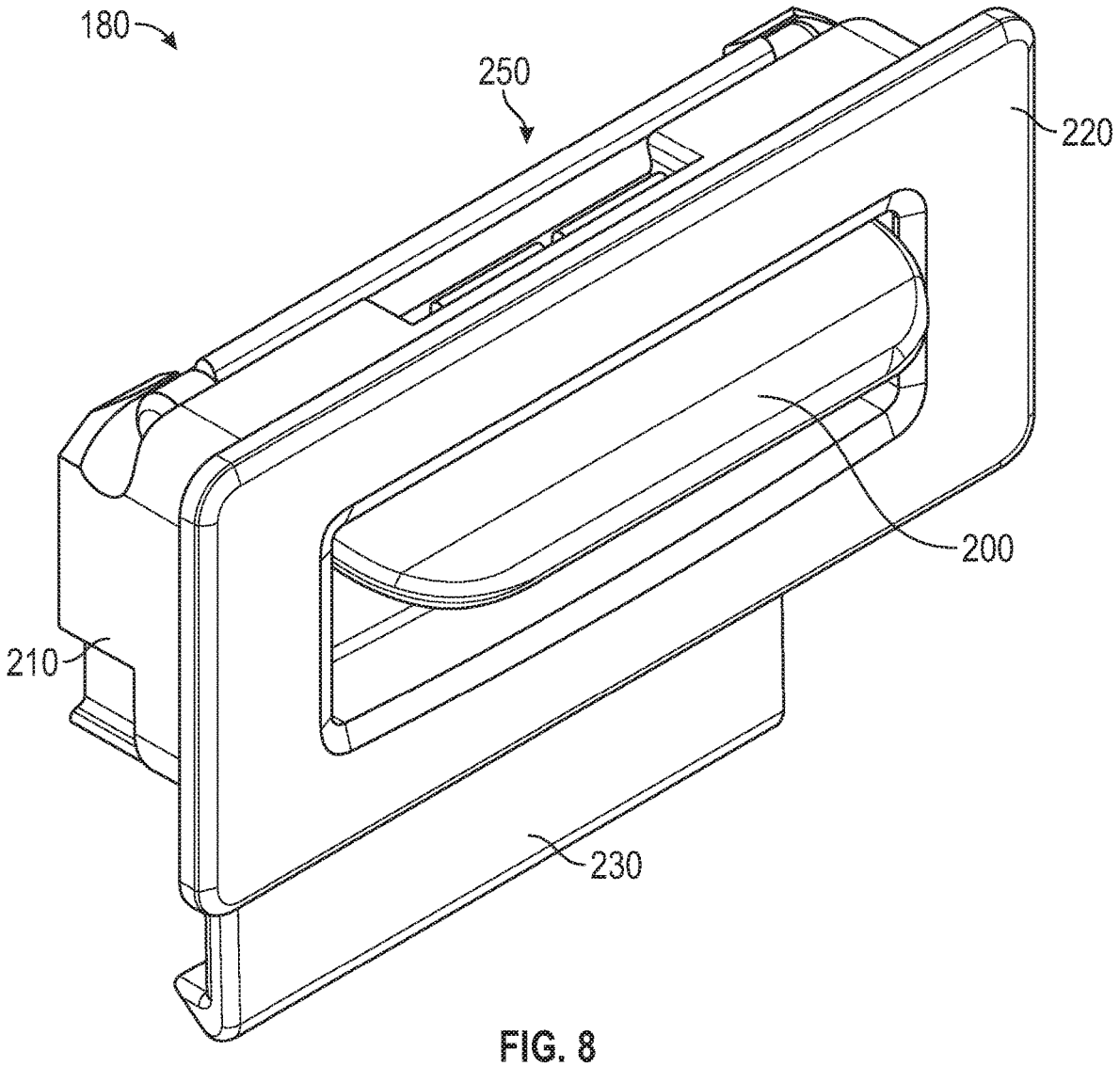
FIG. 8 is a perspective view of another example of a latch assembly.

FIG. 8 is a perspective view of another example of a latch assembly 180. In an example, the latch assembly 180 includes the handle 200, the assembly housing 210, the escutcheon 220, and the latch arm 230. As described in greater detail herein, in some examples, the operator 240 does not include the operator arm 700 (shown in FIG. 7) and instead the handle 200 is coupled (e.g., directly coupled) with the latch arm 230.

Figure 9:
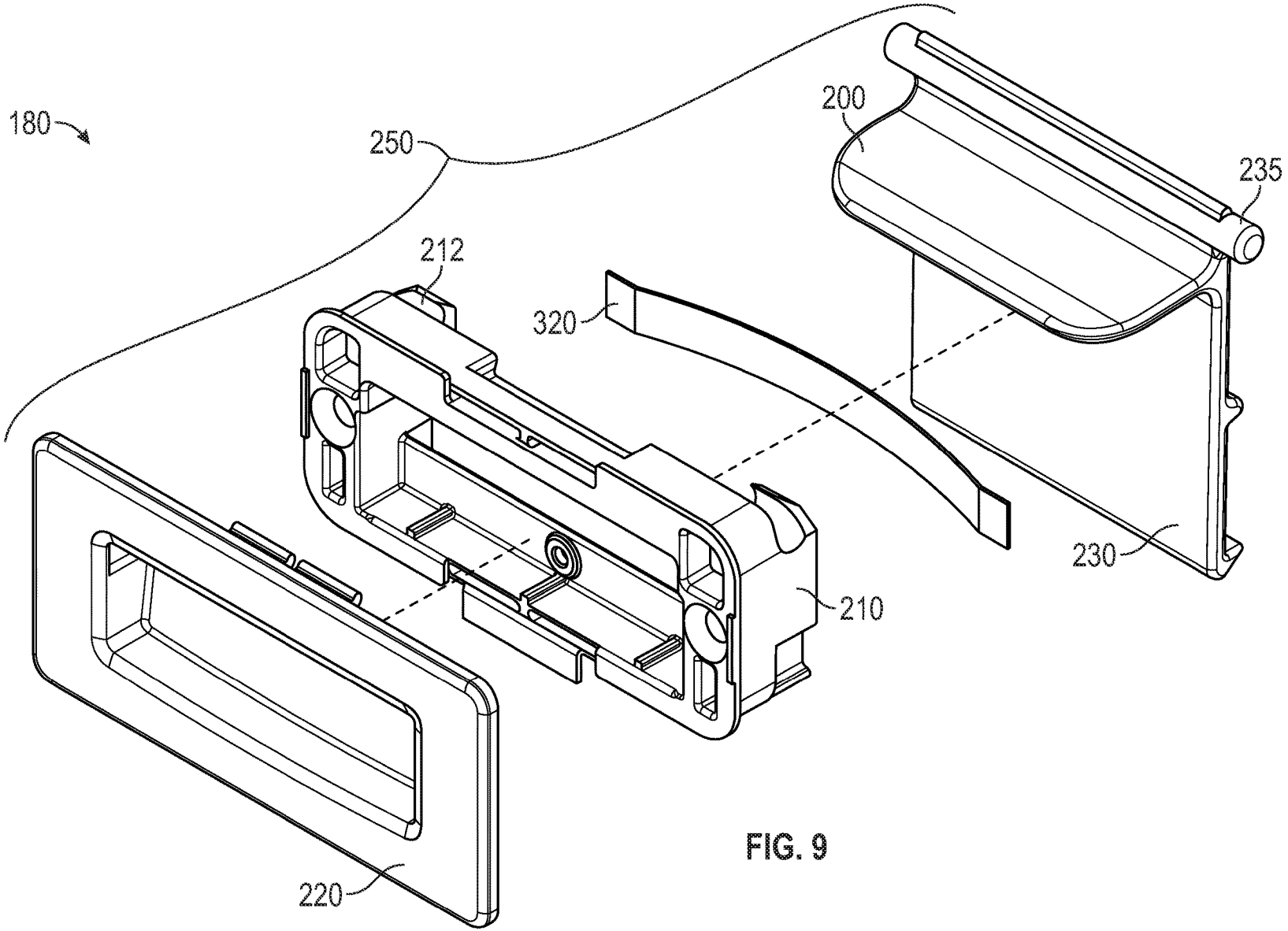
FIG. 9 is an exploded view of the latch assembly of FIG. 8.

FIG. 9 is an exploded view of the latch assembly 180 of FIG. 8. As described herein, the handle 200 is optionally coupled with the latch arm 230. For instance, in some examples, the latch mechanism 250 does not include the operator 240. As a result, operation of the handle 200 more directly moves the latch arm 230 to change the configuration of the locking assembly 180. In this example, the assembly housing 210 does not include a plurality of pivot recesses as previous shown in FIGS. 2B and 3. Instead, the latch pivot 235 of the handle 200 and latch arm 230 is received in the pivot recess 212. Accordingly, operation of the handle (rotation or upward and downward movement causing rotation) rotates the latch pivot 235 within the pivot recess 212 to move the latch arm 230 and change the configuration of the latch assembly 180.

Figure 10:
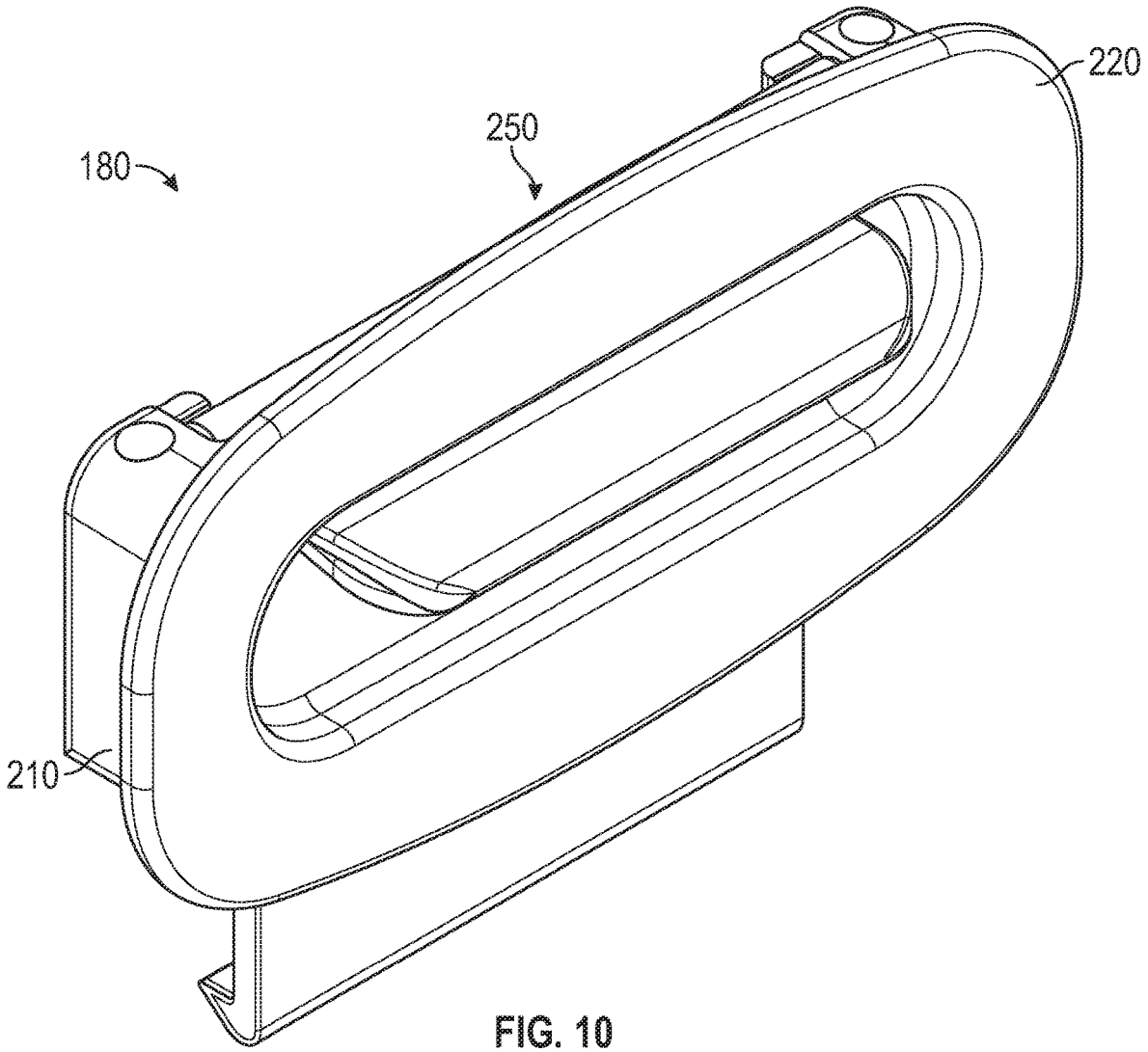
FIG. 10 is a perspective view of an additional example of a latch assembly.

FIG. 10 is a perspective view of an additional example of a latch assembly 180. In an example, the latch assembly 180 includes the handle 200, the assembly housing 210, the escutcheon 220, and the latch arm 230. As described herein and shown in FIGS. 10-11, the escutcheon 220 is integral with the assembly housing 210 (e.g., the escutcheon 220 and the assembly housing 210 are a single piece). In contrast, and as shown in FIGS. 8 and 9, the escutcheon 220 and the assembly housing 210 are separate pieces.

Figure 11:
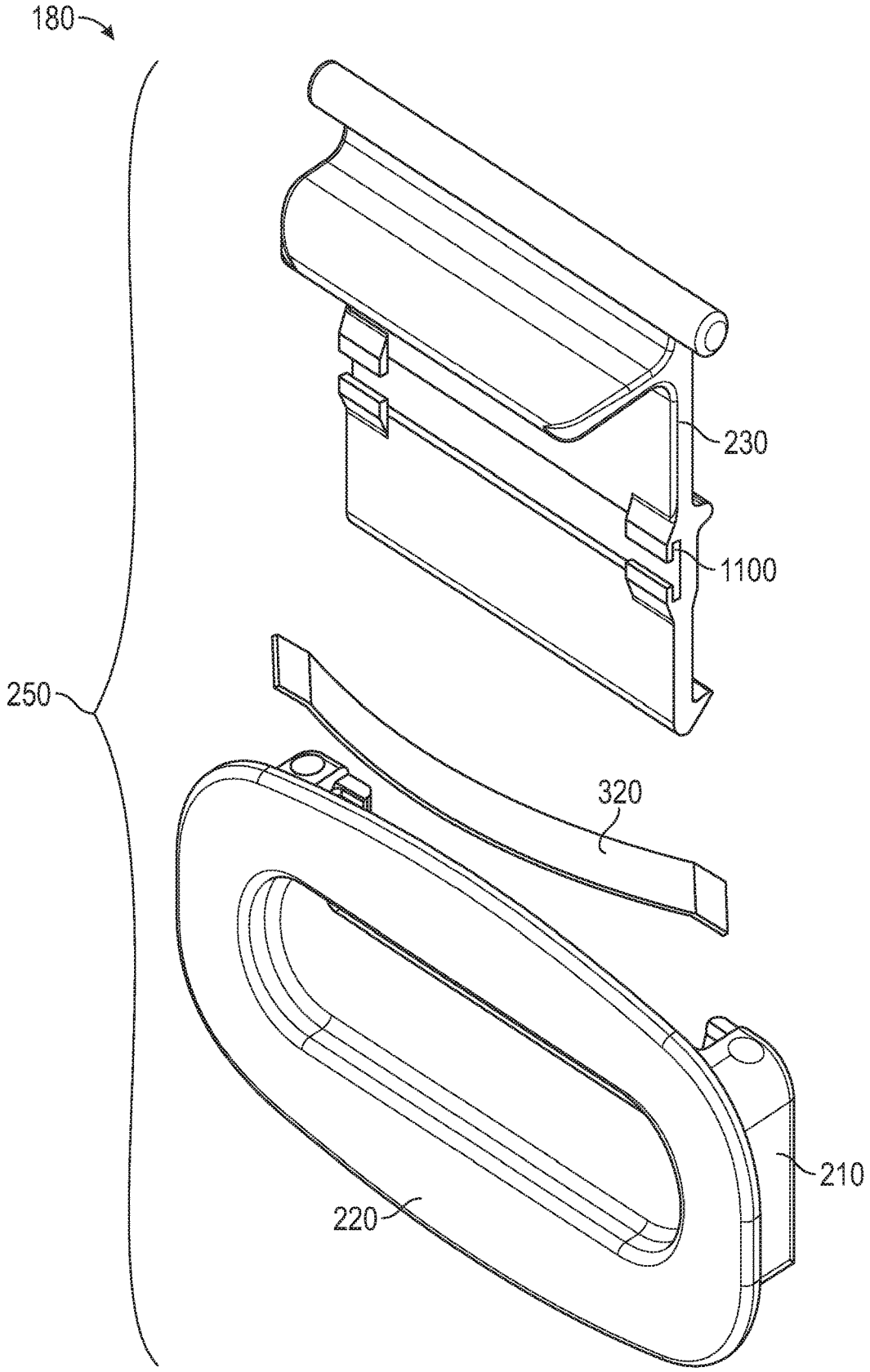
FIG. 11 is an exploded view of the latch assembly of FIG. 10.

FIG. 11 is an exploded view of the latch assembly 180 of FIG. 10. As described herein, in some examples, the escutcheon 220 is integral with the assembly housing 210. Accordingly, the number of components in the latch assembly 180 (e.g., the latch mechanism 250) is thereby reduced. In an example, the assembly housing 210 and the escutcheon 220 do not include the through holes 310 to facilitate the coupling of the assembly housing 210 with the fenestration assembly 100. Instead, the assembly housing 210 optionally includes a housing profile that provides an interference fit with the fenestration assembly 100 (e.g., a recess in the rail 160). In another example, the assembly housing 210 is bonded (e.g., with a glue, epoxy, welding, or the like) to the fenestration assembly 100 and thereby coupled with the fenestration assembly 100.

In an example, the latch arm 230 includes a biasing element recess 1100 that is configured to receive the biasing element 320. Reception of the biasing element 320 in the recess 1100 couples the biasing element 320 with the latch arm 230 and locates the biasing element 320 between the latch arm 320 and the assembly housing 210. Accordingly, the biasing element 320 biases the latch arm 320 away from assembly housing 210.

Figure 12:
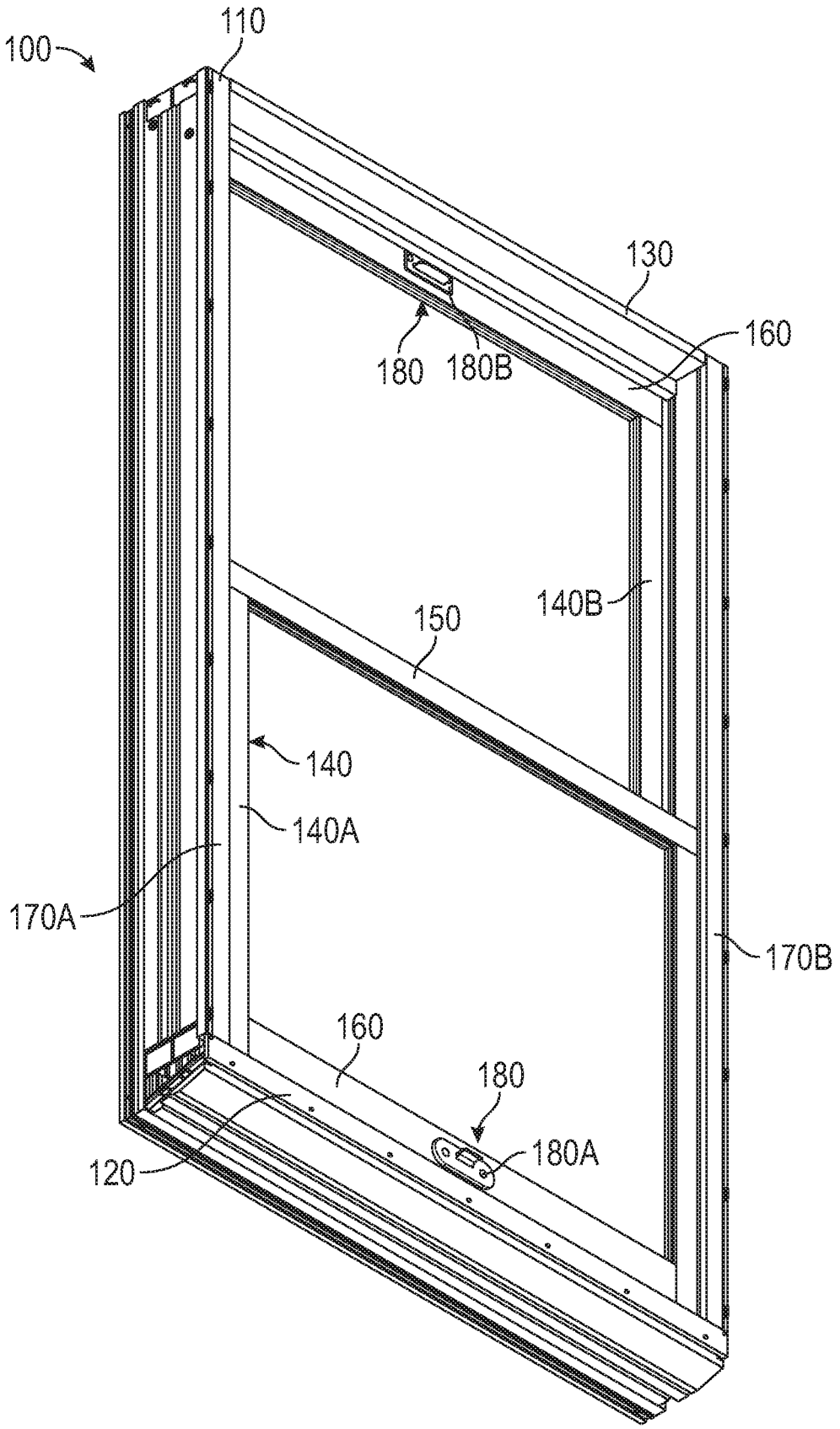
FIG. 12 is a perspective view of another example of a fenestration assembly including a latch assembly coupled between a second sash and a fenestration frame.

FIG. 12 is a perspective view of another example of a fenestration assembly 100 including a latch assembly 180 coupled between a second sash 140B and the fenestration frame 110. As described herein, the latch assembly 180 is coupled with the fenestration assembly 100 (e.g., the one or more sashes 140). In some examples, the fenestration assembly 100 includes a first sash 140A and a second sash 140B. The sashes 140A, 140B are moveable relative to the fenestration frame 110 between an open position and a closed position. The sashes 140 each include the check rail 150 and the opposed rail 160

The fenestration assembly optionally includes a plurality of latch assemblies 180, for instance a first latch assembly 180A and a second latch assembly 180B. In one example, and as shown in FIG. 12, the first latch assembly 180A is optionally coupled with a first sash 140A, and the second latch assembly 180B is coupled with the second sash 140B. For instance, the latch assembly 180A is coupled to rail 160 of the first sash 140A proximate the sill 120, and the latch assembly 180B is coupled to the rail 160 of the second sash 140B proximate the header 130.

In another example, the first latch assembly 180A and the second latch assembly 180B are coupled with the first sash 140A, and one or more additional latch assemblies 180 are coupled with the second sash 140B. In an example, the first latch assembly 180A is coupled to the first sash 140A proximate a first stile 170A, and the second latch assembly 180B is coupled to the first sash 140A proximate a second stile 170B.

Figure 13:
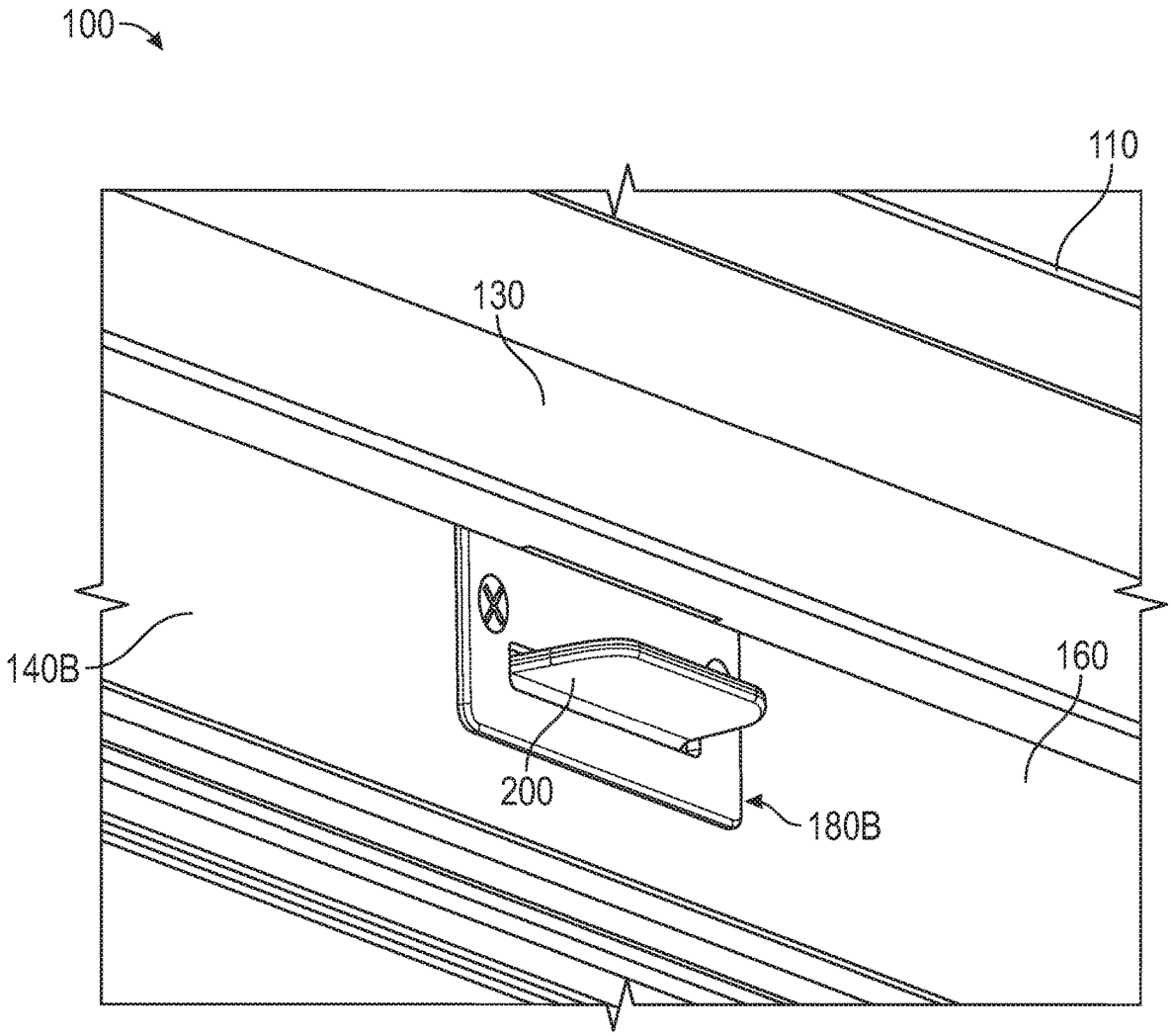
FIG. 13 is a perspective view of the latch assembly of FIG. 12.

FIG. 13 is a perspective view of the latch assembly 180B of FIG. 12. As described herein, the second latch assembly 180B is optionally coupled with the second sash 140B (e.g., the rail 160). In some examples, the handle 200 of the second latch assembly 180B is proximate the header 130 when the second sash 140B is in the closed position.

Figure 14:
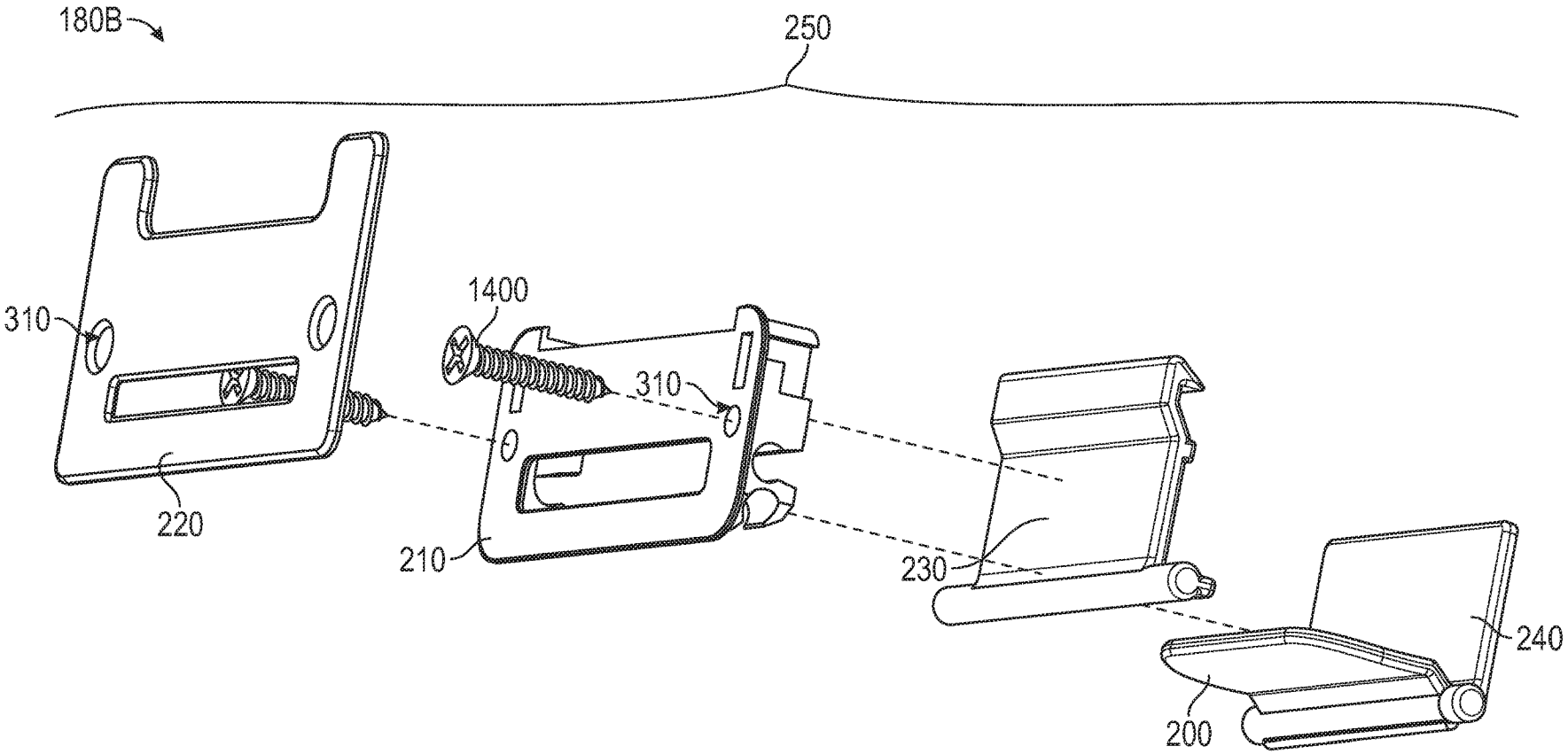
FIG. 14 is an exploded view of the latch assembly of FIG. 12.

FIG. 14 is an exploded view of the latch assembly 180B of FIG. 12. As described herein, the latch assembly 180 includes the latch mechanism 250. In an example, the latch mechanism 250 includes the assembly housing 210, the escutcheon 220, the latch arm 230, the operator 240 (including the handle 200), the one or more through holes 310, and one or more fasteners 1400. The one or more fasteners are optionally received in the through holes 310 and facilitate coupling the locking mechanism with the fenestration assembly 100 (shown in FIG. 12).

FIG. 15A is a cross sectional view of the latch assembly 180B of FIG. 13 in a locked configuration. In the locked configuration, the latch arm 230 of the latch mechanism 250 is engaged with the keeper 400 to hold the sash 140 static relative to the fenestration frame 110 (e.g., the header 130). The locking face 231 of the latch arm 230 is aligned with the keeper ridge 420 and positioned thereunder. Optionally, while aligned the latch arm 230 is engaged against the ridge 420, the locking face 231 is seated under the ridge 420 or spaced therefrom through tolerance or design. With this arrangement of the locking face 231 aligned to the keeper 400 the sash 140B is locked in the fenestration frame 110 in the closed position. In this example, if a user attempts to move the sash 140 relative to the frame 110, the engagement of the locking face 231 with the keeper ridge 420 prevents movement of the sash 140 relative to the frame 110.

Figure 15B:
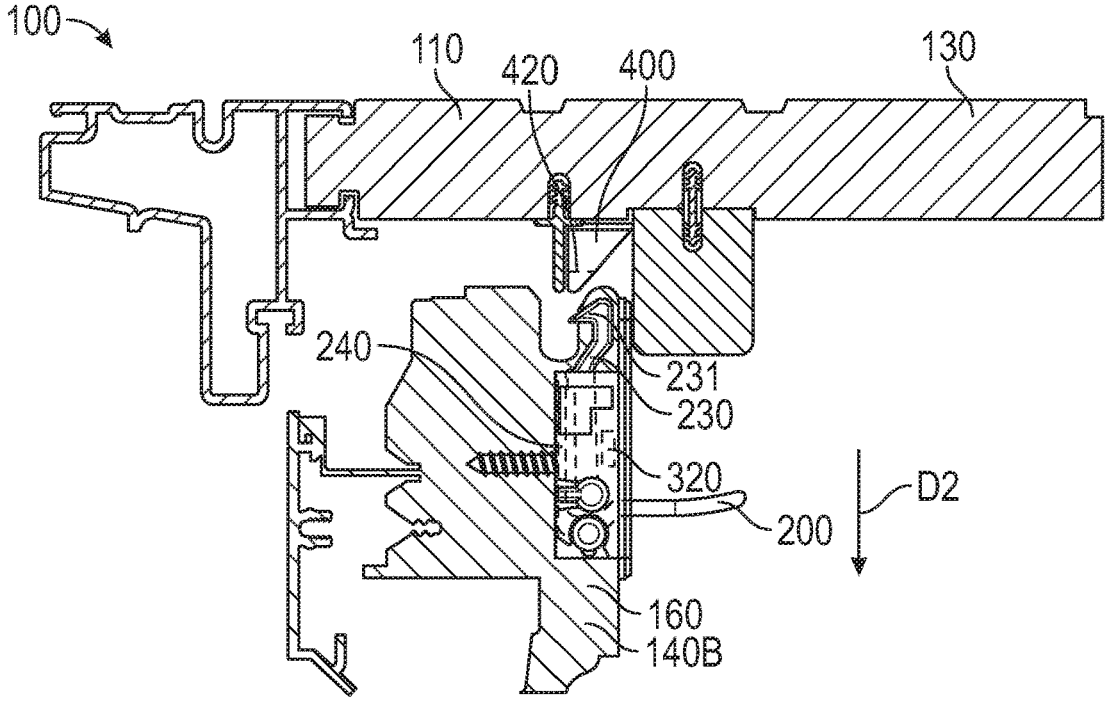
FIG. 15B is a cross sectional view of the latch assembly of FIG. 13 in an unlocked configuration.

FIG. 15B is a cross sectional view of the latch assembly 180B of FIG. 13 in an unlocked configuration. In the unlocked configuration, the latch arm 230 of the latch mechanism 250 is misaligned relative to the keeper 400. Accordingly, the sash 140 is freed and movable relative to the frame 110 (e.g., the header 130) toward the open position. In this example, the handle 200 initiates the change in configuration. For instance, the handle 200 is moved in the direction of arrow D2. Movement of the handle 200 operates the latch mechanism 250 to move the latch arm 230 and misalign the locking face 231 with the keeper ridge 420 (also shown in FIG. 4) to unlock the latching assembly 180. In some examples, movement of the handle 200 overcomes the bias of the biasing element 320 and, for instance, compresses the biasing element 320 while moving the latch arm 230. Accordingly, the latch arm 230 is biased toward the assembly housing 210. Optionally, continued movement of the handle 200 in the direction of arrow D2 is transmitted to the sash 140 to open the sash. Accordingly, the sash 140 is unlocked and opened in a single movement by the user instead of requiring multiple operations to unlock the sash 140 and move the sash toward the open position through pulling on a finger pull lifting at the checkrail or the like.

Figure 16:
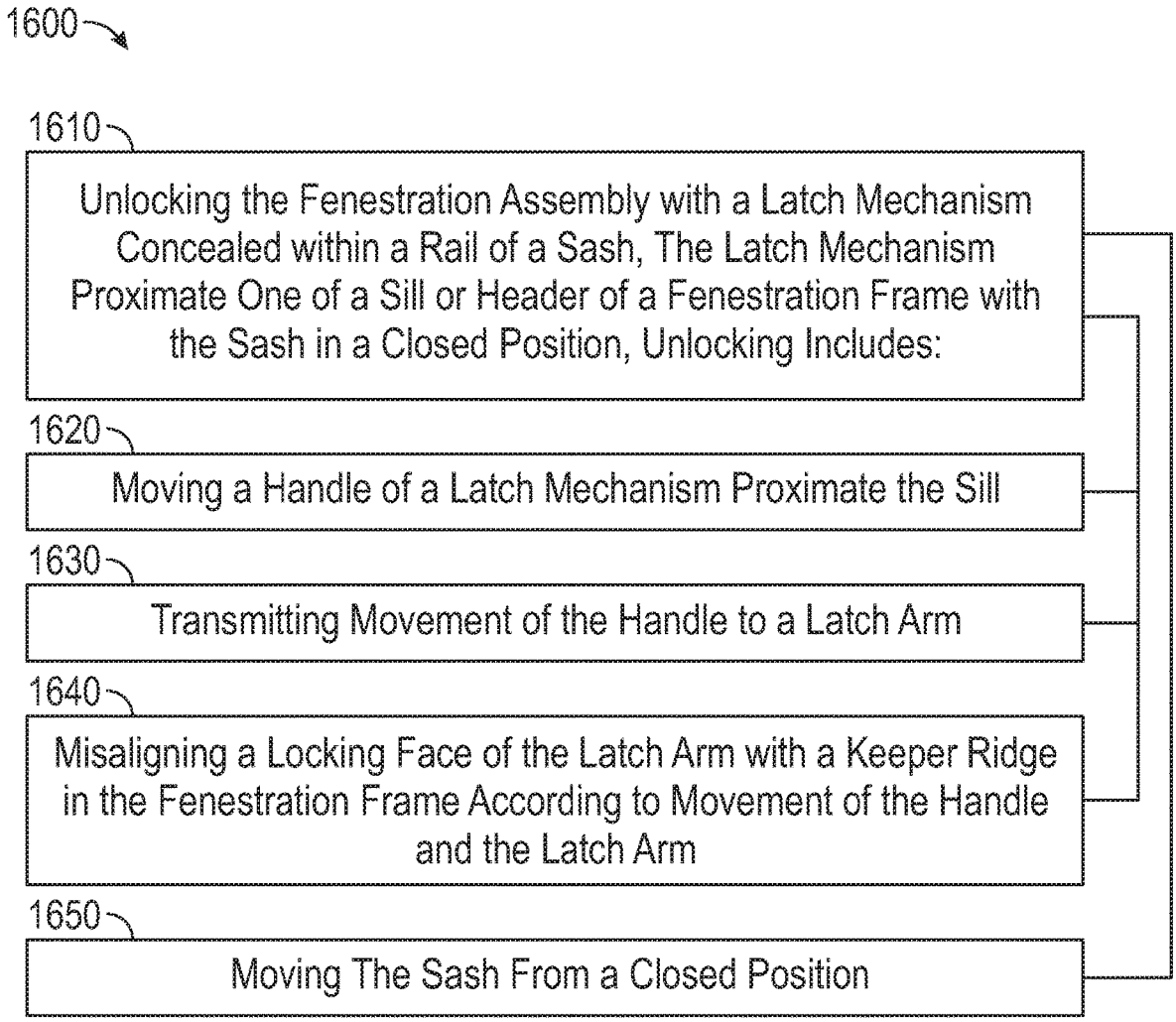
FIG. 16 is a block diagram showing one example of a method for operating a fenestration assembly.

FIG. 16 is a block diagram showing one example of a method 1600 for operating a fenestration assembly 100. In describing the method 1600, reference is made to one or more components, features, functions and operations previously described herein. Where convenient, reference is made to the components, features, operations and the like with reference numerals. The reference numerals provided are exemplary and are not exclusive. For instance, components, features, functions, operations and the like described in the method 1600 include, but are not limited to, the corresponding numbered elements provided herein and other corresponding elements described herein (both numbered and unnumbered) as well as their equivalents.

At 1610, the fenestration assembly 100 is unlocked with a latch mechanism 250 concealed within a rail 160 of a sash 140, the latch mechanism 250 proximate one of a sill 120 or header 130 of a fenestration frame 110 with the sash 140 in a closed position. At 1620, unlocking the fenestration assembly 100 includes moving a handle 200 of the latch mechanism 250 proximate the sill 120.

At 1630, unlocking the fenestration assembly 100 includes transmitting movement of the handle 200 to a latch arm 230. For instance, the handle 200 is optionally pivoted and an operator 240 coupled with the handle is pivoted. An operator arm 700 of the operator 240 is engaged against the latch arm 230. The latch arm 230 is pivoted to misalign the locking face 231 of the latch arm 230 with the keeper ridge 420. In some examples, pivoting the handle 200 and the operator 240 includes pivoting at an operator pivot 245, and pivoting the latch arm 230 includes pivoting at a latch pivot 235 different than the operator pivot 245. Additionally, engaging the operator arm 700 against the latch arm 230 optionally includes engaging the operator arm 700 between the locking face 231 and the latch pivot 235 of the latch arm 230. Further, in some examples, each of transmitting movement of the handle 200 to the latch arm 230 and misaligning the locking face 231 with the keeper ridge 420 is concealed by one or more of the rail 160 of the sash 140 or the sill 120 or header 130 of the fenestration frame 110.

At 1640, unlocking the fenestration assembly 100 includes misaligning a locking face 231 of the latch arm 230 with a keeper ridge 420 in the fenestration frame 110 according to movement of the handle 200 and the latch arm 230. The method 1600 includes at 1650 moving the sash from a closed position.

Several options for the method 1000 follow. For instance, the latch arm 230 is optionally biased toward alignment with the keeper ridge 420 with a biasing element 320. In another example, the sash 140 is moved toward the closed position. The sash 140 is automatically locked in the closed position with the latch mechanism 250. For instance, automatically locking optionally includes engaging the latch arm 230 with at least one of the fenestration frame 110 or the keeper ridge 420. Additionally, the latch arm 230 is optionally biased to misalign the locking face 231 with the keeper ridge 420 according to the engagement of the latch arm 230 with the with at least one of the fenestration frame 110 or the keeper ridge 420. Further, the bias of the latch arm 230 is released with movement of the locking face 231 past the keeper ridge 420, and the locking face 231 aligning with the keeper ridge 420 with release of the bias.

Various Notes & Examples

Example 1 can include subject matter, such as a fenestration assembly comprising: a fenestration frame; at least one sash slidably coupled within the fenestration frame and movable between open and closed positions, the at least one sash includes a check rail, rail an opposed rail opposed to the check rail, and stiles; a latch assembly having locked and unlocked configurations, the latch assembly includes: a keeper ridge coupled with the fenestration frame, an assembly housing concealed within the opposed rail, a latch mechanism movably coupled with the assembly housing wherein the latch mechanism includes: a handle extending from the assembly housing, and a latch arm coupled with the handle and concealed by the rail, the latch arm includes a locking face configured for alignment with the keeper ridge; in the locked configuration the locking face of the latch arm is aligned with the keeper ridge, and the at least one sash is held static within the fenestration frame at the closed position; and in the unlocked configuration the handle and latch arm are moved relative to the locked configuration, the locking face is misaligned with the keeper ridge, and the at least one sash is slidable within the fenestration frame.

Example 2 can include, or can optionally be combined with the subject matter of Example 1, to optionally include, wherein the handle and latch arm are proximate a sill of the fenestration frame with the sash in the closed position.

Example 3 can include, or can optionally be combined with the subject matter of one or any combination of Examples 1 or 2 to optionally include, wherein the handle and latch arm are proximate a header of the fenestration frame with the sash in the closed position.

Example 4 can include, or can optionally be combined with the subject matter of one or any combination of Examples 1-3 to optionally include, wherein the latch mechanism includes a biasing element coupled with the latch arm, and the biasing element biases the locking face toward alignment with the keeper ridge.

Example 5 can include, or can optionally be combined with the subject matter of one or any combination of Examples 1-4 to optionally include, wherein the latch arm includes a resetting face, and the resetting face is configured to: engage the fenestration frame with movement of the sash to the closed position, and bias the locking face toward misalignment with the keeper ridge until the sash is in the closed position.

Example 6 can include, or can optionally be combined with the subject matter of Examples 1-5 to optionally include, wherein the latch arm and the handle are pivotally coupled with the assembly housing.

Example 7 can include, or can optionally be combined with the subject matter of Examples 1-6 to optionally include, wherein the latch mechanism includes an operator interposed between the handle and the latch arm, the operator includes: a first end coupled with the handle, an operator arm extending from the first end toward a second end and the operator arm, the second end of the latch arm is configured for engagement and disengagement from the latch arm.

Example 8 can include, or can optionally be combined with the subject matter of Examples 1-7 to optionally include, wherein the second end of the operator arm includes a boss extending from the operator arm toward the latch arm.

Example 9 can include, or can optionally be combined with the subject matter of Examples 1-8 to optionally include, wherein in the unlocked configuration the handle moves the second end of the operator arm into engagement with the latch arm and the locking face is biased into misalignment with the keeper ridge.

Example 10 can include, or can optionally be combined with the subject matter of Examples 1-9 to optionally include, wherein in the locked configuration the second end of the operator arm is disengaged with the latch arm, and the locking face is biased into alignment with the keeper ridge.

Example 11 can include, or can optionally be combined with the subject matter of Examples 1-10 to optionally include, wherein the at least one sash includes a first sash and a second sash, and each of the first and second sashes includes respective check rails, rails opposed to the respective check rails, and stiles, and wherein the assembly housing is concealed within at least one of the rails opposed to the respective check rails, and the keeper ridge is coupled with a portion of the fenestration frame adjacent to the assembly housing with the first or second sash in the closed position.

Example 12 can include, or can optionally be combined with the subject matter of Examples 1-11 to optionally include a latch assembly for a fenestration assembly comprising: a keeper ridge configured for coupling with a fenestration frame; an assembly housing configured for coupling within a rail of a sash; a latch mechanism movably coupled with the assembly housing, the latch mechanism is at least partially within the assembly housing, and the latch mechanism includes: a handle pivotally coupled with the assembly housing a latch arm pivotally coupled with the assembly housing, the latch arm includes a locking face configured for alignment with the keeper ridge, and an operator interposed between the handle and the latch arm, the operator including an operator arm extending from a first end proximate the handle to a second end proximate the latch arm, wherein the second end is configured for engagement and disengagement from the latch arm.

Example 13 can include, or can optionally be combined with the subject matter of Examples 1-12 to optionally include, wherein the latch assembly includes locked and unlocked configurations: in the locked configuration the locking face of the latch arm is aligned with the keeper ridge; and in the unlocked configuration the handle and operator arm are moved relative to the locked configuration and misalign the locking face with the keeper ridge.

Example 14 can include, or can optionally be combined with the subject matter of Examples 1-13 to optionally include, wherein in the unlocked configuration the handle and the operator pivot together, and the second end of the operator arm engages with the latch arm, pivots the latch arm, and misaligns the locking face with the keeper ridge.

Example 15 can include, or can optionally be combined with the subject matter of Examples 1-14 to optionally include, wherein the handle and the operator are integral.

Example 16 can include, or can optionally be combined with the subject matter of Examples 1-15 to optionally include, wherein handle and the operator are pivotally coupled with the assembly housing at an operator pivot.

Example 17 can include, or can optionally be combined with the subject matter of Examples 1-16 to optionally include, wherein the latch arm is pivotally coupled with the assembly housing at a latch pivot.

Example 18 can include, or can optionally be combined with the subject matter of Examples 1-17 to optionally include, wherein the second end of the operator arm is on a first side of the latch pivot and between the latch pivot and the locking face, and an operator pivot of the handle and the operator is on a second side of the latch pivot.

Example 19 can include, or can optionally be combined with the subject matter of Examples 1-18 to optionally include, wherein the latch mechanism includes a biasing element coupled with the latch arm, and the biasing element biases the locking face toward alignment with the keeper ridge.

Example 20 can include, or can optionally be combined with the subject matter of Examples 1-19 to optionally include, wherein the second end of the operator arm includes a boss extending from the operator arm toward the latch arm.

Example 21 can include, or can optionally be combined with the subject matter of Examples 1-20 to optionally include a fenestration frame and at least one sash movable within the fenestration frame, wherein: the assembly housing and at least a portion of the latch mechanism are concealed within a rail of the least one sash opposed to a check rail of the at least one sash, and the keeper ridge is coupled with the fenestration frame.

Example 22 can include, or can optionally be combined with the subject matter of Examples 1-21 to optionally include a method for operating a fenestration assembly comprising: unlocking the fenestration assembly with a latch mechanism concealed within a rail of a sash, the latch mechanism proximate one of a sill or header of a fenestration frame with the sash in a closed position, unlocking includes: moving a handle of a latch mechanism proximate the sill, transmitting movement of the handle to a latch arm, and misaligning a locking face of the latch arm with a keeper ridge in the fenestration frame according to movement of the handle and the latch arm; and moving the sash from a closed position.

Example 23 can include, or can optionally be combined with the subject matter of Examples 1-22 to optionally include, wherein transmitting movement of the handle to the latch arm includes: pivoting the handle and an operator coupled with the handle, engaging an operator arm of the operator against the latch arm, and pivoting the latch arm to misalign the locking face of the latch arm with the keeper ridge.

Example 24 can include, or can optionally be combined with the subject matter of Examples 1-23 to optionally include, wherein pivoting the handle and the operator includes pivoting at an operator pivot, and pivoting the latch arm includes pivoting at a latch pivot different than the operator pivot.

Example 25 can include, or can optionally be combined with the subject matter of Examples 1-24 to optionally include, wherein engaging the operator arm against the latch arm includes engaging the operator arm between the locking face and a latch pivot of the latch arm.

Example 26 can include, or can optionally be combined with the subject matter of Examples 1-25 to optionally include, wherein each of transmitting movement of the handle to the latch arm and misaligning the locking face with the keeper ridge is concealed by one or more of the rail of the sash or the sill or header of the fenestration frame.

Example 27 can include, or can optionally be combined with the subject matter of Examples 1-26 to optionally include biasing the latch arm toward alignment with the keeper ridge with a biasing element.

Example 28 can include, or can optionally be combined with the subject matter of Examples 1-27 to optionally include moving the sash toward the closed position, and automatically locking the sash in the closed position with the latch mechanism, automatically locking includes: engaging the latch arm with at least one of the fenestration frame or the keeper ridge, biasing the latch arm to misalign the locking face with the keeper ridge according to the engagement, and releasing the bias of the latch arm with movement of the locking face past the keeper ridge, and the locking face aligning with the keeper ridge with release of the bias.

Example 29 can include or use, or can optionally be combined with any portion or combination of any portions of any one or more of Examples 1 through 28 to include or use, subject matter that may include means for performing any one or more of the functions of Examples 1 through 28.

Each of these non-limiting examples can stand on its own, or can be combined in various permutations or combinations with one or more of the other examples.

The above description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are op en-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Geometric terms, such as "parallel", "perpendicular", "round", or "square", are not intended to require absolute mathematical precision, unless the context indicates otherwise. Instead, such geometric terms allow for variations due to manufacturing or equivalent functions. For example, if an element is described as "round" or "generally round," a component that is not precisely circular (e.g., one that is slightly oblong or is a many-sided polygon) is still encompassed by this description.

The above description is intended to be illustrative, and not restrictive. For example, the above-described examples (or one or more aspects thereof) may be used in combination with each other. Other embodiments can be used, such as by one of ordinary skill in the art up on reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. A latch assembly for a fenestration assembly comprising:

a keeper ridge configured for coupling with a frame of the fenestration assembly;

an assembly housing configured for coupling within a rail of a sash of the fenestration assembly;

a latch mechanism coupled with the assembly housing, the latch mechanism is at least partially disposed within the assembly housing, and the latch mechanism includes:

a handle assembly including a handle, the handle pivotally coupled to the assembly housing about a first pivot axis, wherein the handle assembly includes an operator arm having a first end pivotally coupled to the assembly housing about the first pivot axis and a second end distal from the first end;

a latch arm pivotally coupled to the assembly housing about a second pivot axis, the latch arm includes a locking face configured for engagement with the keeper ridge; and wherein the latch mechanism is movable between opening and closing configurations:

in the closing configuration, the handle is pivoted in a first direction and the second end of the operator arm is separated from the latch arm; and in the opening configuration, the handle is pivoted in a second direction and the second end of the operator arm is engaged with the latch arm to move the locking face from engagement with the keeper ridge.

2. The latch assembly of claim 1, wherein the latch assembly includes a locked configuration, and in the locked configuration the locking face of the latch arm engages with the keeper ridge.

3. The latch assembly of claim 1, wherein in the opening configuration, the handle and the operator arm pivot together, and the second end of the operator arm engages with the latch arm, pivots the latch arm, and misaligns the locking face with the keeper ridge.

4. The latch assembly of claim 1, wherein the handle and the operator arm are integral.

5. The latch assembly of claim 1, wherein the handle and the operator arm are pivotally coupled with the assembly housing via an operator pivot.

6. The latch assembly of claim 5, wherein the latch arm is pivotally coupled with the assembly housing via a latch pivot.

7. The latch assembly of claim 6, wherein the second end of the operator arm is between the latch pivot and the locking face, and the latch pivot is between the operator pivot and the second end of the operator arm.

8. The latch assembly of claim 1, wherein the latch mechanism includes a biasing element coupled with the latch arm, and the biasing element biases the locking face toward the keeper ridge.

9. A fenestration assembly comprising:

a fenestration frame;

at least one sash slidably coupled within the fenestration frame and movable between open and closed positions, and a latch assembly including:

a keeper ridge coupled with the frame;

an assembly housing coupled within a rail of the sash;

a latch mechanism coupled with the assembly housing, the latch mechanism is at least partially disposed within the assembly housing, and the latch mechanism includes:

a handle assembly including a handle, the handle pivotally coupled to the assembly housing about a first pivot axis, wherein the handle assembly includes an operator arm having a first end pivotally coupled to the assembly housing about the first pivot axis and a second end distal from the first end;

a latch arm pivotally coupled to the assembly housing about a second pivot axis, the latch arm includes a locking face configured for engagement with the keeper ridge; and wherein the latch mechanism is movable between opening and closing configurations:

in the closing configuration, the handle is pivoted in a first direction and the second end of the operator arm is separated from the latch arm; and in the opening configuration, the handle is pivoted in a second direction and the second end of the operator arm is engaged with the latch arm to move the locking face from engagement with the keeper ridge.

10. The fenestration assembly of claim 9, wherein:

the assembly housing and at least a portion of the latch mechanism are concealed within the rail of the sash.

* * * * *